US007147217B2

(12) United States Patent
Jung et al.

(10) Patent No.: US 7,147,217 B2
(45) Date of Patent: Dec. 12, 2006

(54) PAPER BINDING SYSTEM OF IMAGE FORMING APPARATUS AND METHOD FOR CONTROLLING THE SAME

(75) Inventors: Yeon-Kwan Jung, Seoul (KR); Umehara Kenji, Tokyo (JP); Jeong-Ho Kim, Seoul (KR); Jae-Geol Choi, Seoul (KR); Seung-Gweon Lee, Gyeonggi-do (KR)

(73) Assignees: KRDC Co., Ltd., Seoul (KR); Gradco Ltd., Tokyo (JP)

( * ) Notice: Subject to any disclaimer, the term of this patent is extended or adjusted under 35 U.S.C. 154(b) by 190 days.

(21) Appl. No.: 10/483,377

(22) PCT Filed: Jul. 18, 2002

(86) PCT No.: PCT/KR02/01354

§ 371 (c)(1),
(2), (4) Date: May 10, 2004

(87) PCT Pub. No.: WO03/009065

PCT Pub. Date: Jan. 30, 2003

(65) Prior Publication Data

US 2004/0183246 A1 Sep. 23, 2004

(30) Foreign Application Priority Data

Jul. 19, 2001 (KR) ..... 2001/43548
Feb. 21, 2002 (KR) ..... 2002/9315
Jun. 27, 2002 (KR) ..... 2002/36191
Jun. 27, 2002 (KR) ..... 2002/36192

(51) Int. Cl.
*B41L 43/12* (2006.01)

(52) U.S. Cl. ..... 270/37; 270/32

(58) Field of Classification Search ..... 270/32, 270/37, 39.06, 39.08, 45; 493/444, 445
See application file for complete search history.

(56) References Cited

U.S. PATENT DOCUMENTS 1,501,774 A * 7/1924 Heeter et al. ..... 493/356
4,270,742 A * 6/1981 Kobayashi ..... 270/37
5,964,154 A * 10/1999 Michalik ..... 101/247
6,004,254 A * 12/1999 Murata ..... 493/444
6,145,825 A * 11/2000 Kunihiro et al. ..... 271/58.09
6,475,129 B1 * 11/2002 Lehmann ..... 493/421
6,568,668 B1 * 5/2003 Wakabayashi et al. ... 270/58.11

FOREIGN PATENT DOCUMENTS

JP 2001019268 A * 1/2001

* cited by examiner

*Primary Examiner*—Khoi H. Tran
(74) *Attorney, Agent, or Firm*—Greenblum & Bernstein, P.L.C.

(57) ABSTRACT

A paper binding system of an image forming apparatus, such as a printer and a copier, and a method for controlling the same are disclosed, in which finishing processes such as stapling and folding are performed by exactly gripping papers ejected from the image forming apparatus without any scattering. The paper binding system of the image forming apparatus includes a paper moving means 150 moving papers ejected from the image forming apparatus, a paper positioning unit 88 temporarily receiving the papers moved from the paper moving means and positioning them, a stapler unit 84 stapling the papers received in the paper positioning unit, a folding means 151 folding the stapled papers, and an eject tray 135 receiving the papers finished through the stapler unit and/or the folding means.

24 Claims, 17 Drawing Sheets

PAPER BINDING SYSTEM OF IMAGE FORMING APPARATUS AND METHOD FOR CONTROLLING THE SAME

TECHNICAL FIELD

The present invention relates to a paper binding system of an image forming apparatus such as a printer and a copier and a method for controlling the same, and more particularly to a paper binding system that can bind, staple, and fold papers ejected from an image forming apparatus by exactly gripping them without any scattering and can stably align the finished papers to eject them outwardly.

BACKGROUND ART

An example of a related art paper binding system (paper folding apparatus) of an image forming apparatus such as a copier is disclosed in U.S. Pat. No. 6,004,254.

The related art paper folding apparatus of an image forming apparatus will be described with reference to FIG. 1.

Referring to FIG. 1, a reference numeral 1 denotes an image forming apparatus (copier), and a reference numeral 2 denotes a paper folding apparatus.

The paper folding apparatus 2 directly ejects papers finished from the copier 1 onto a stack tray 7 by controlling an inlet flap 3 or binds the papers using a stapler unit (stapler head 18 and a stapler anvil 19), folding rollers 26 and 27, and a paper positioning unit 28 to eject them onto an eject tray 35.

The operation of folding papers ejected from the copier 1 will be described in more detail.

The papers ejected from the copier 1 move to paper guides 11 and 12 of the folding apparatus by passing through rollers 4 provided in a paper eject outlet of a main body of the copier. The papers moved to the paper guides 11 and 12 move between the stapler head 18 and the stapler anvil 19 through eject rollers 13 and 14 and then ends of the papers are aligned in a base 6 of the paper positioning unit 28.

The paper positioning unit 28 includes a paper position sensor 63 that moves the paper positioning unit in a direction of an arrow 'a' in accordance with a signal of the paper position sensor 63.

If the paper position sensor senses small sized papers, the paper positioning unit 28 moves to the position of the small sized papers in accordance with a sensed signal of the paper position sensor. If the paper position sensor senses big sized papers, the paper positioning unit 28 moves to the position of the big sized papers in accordance with the sensed signal of the paper position sensor.

Meanwhile, when the papers are aligned in the paper positioning unit 28, respective plate springs 5*a* and 5*b* prevent the papers from moving to the paper positioning unit. Accordingly, to facilitate movement of the papers to the paper positioning unit, the upper semi-circular roller 17 and the lower semi-circular roller 9 have an eccentric cam shape.

In other words, when the papers move to align the ends of the papers in the base 6 of the paper position unit 28, flat portions of the upper and lower semi-circular rollers face the plate springs 5*a* and 5*b*, respectively, thereby forming a space between the plate springs and the upper and lower semi-circular rollers. The space serves to facilitate movement of the papers. When the papers moved to the paper positioning unit are stapled using the stapler head 18 and the stapler anvil 19, or are folded using folding rollers 26 and 27, curved surfaces of the semi-circular rollers closely face the respective plate springs by rotating the upper and lower semi-circular rollers. Thus, the papers are supported between the semi-circular rollers and the plate springs.

The central parts of the papers supported between the semi-circular rollers 9 and 17 and the plate springs 5*a* and 5*b* are stapled by the stapler head 18 and the stapler anvil 19. The upper and lower semi-circular rollers 9 and 17 support the papers to place the stapled parts of the papers at inlets of the folding rollers 26 and 27. Then, the upper and lower semi-circular rollers 9 and 17 move at the same time.

In this state, the upper and lower semi-circular rollers are rotated in opposite directions and at the same time a knife 25*a* provided in a protrusion unit 25 pushes the stapled parts of the papers to the folding rollers 26 and 27. If the stapled parts are supported by the folding rollers, the papers are folded by half by means of action of the folding rollers 26 and 27 and then pushed between the folding rollers, thereby completing binding of the papers. The papers passed through the folding rollers are ejected to the eject tray 35.

Meanwhile, reference numerals 15 and 16 denote switch flaps that guide the papers passed through the eject rollers to be aligned in the paper positioning unit 28 in the order of page or ejection.

In the aforementioned related art paper binding system, the binding papers are supported by elasticity of the plate springs 5*a* and 5*b* provided at an opposite side of the upper and lower semi-circular rollers 17 and 9. Therefore, reliability in supporting the papers depends on how many papers are bound, i.e., the thickness of the binding papers.

Furthermore, since a number of the binding papers are moved by rotation of the upper and lower semi-circular rollers, the papers which are not in contact with the upper and lower semi-circular rollers may not be moved.

Moreover, as shown in FIG. 1, since a moving path of the papers is curved, desirable movement of the papers may not be carried out.

DISCLOSURE OF THE INVENTION

Accordingly, the present invention is directed to a paper binding system of an image forming apparatus and a method for controlling the same that substantially obviate one or more of the problems due to limitations and disadvantages of the related art.

An object of the present invention is to provide a paper binding system of an image forming apparatus and a method for controlling the same in which a paper moving means and a paper positioning unit have an improved structure so as to bind papers by exactly and stably supporting them.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, a paper binding system of an image forming apparatus includes a paper moving means 150 moving papers ejected from the image forming apparatus, a paper positioning unit 88 temporarily receiving the papers moved from the paper moving means and positioning them, a stapler unit 84 stapling the papers received in the paper positioning unit, a folding means 151 folding the stapled papers, and an eject tray 135 receiving the papers finished through the stapler unit and/or the folding means.

The paper binding system of an image forming apparatus according to the present invention, as shown in FIGS. 2 to 9, includes a paper moving means 150. The paper moving means 150 includes an inlet motor 101 driving an upper roller 86, a conveyer motor 102 driving a lower roller 85, an inlet solenoid 112 changing an eject path of papers, a conveyer path switch solenoid 111 changing a moving path of the papers in accordance with the size of the papers moving along an inlet stack guide 83, and a paddle motor 42 driving a paddle 41 to allow the paddle 41 to align the papers.

The paddle motor 42 rotates the paddle fitted into a paddle shaft 44 by means of a paddle driving timing belt 43.

Meanwhile, a paper positioning unit 88 temporarily receives the papers moving from the paper moving means and positions the papers. The paper positioning unit 88 includes a grip motor 10 driving a grip plate 30, a jogger moving motor 70 driving a jogger 61, and a horizontal aligning motor 109 driving a paper horizontal aligning unit (not shown) that uniformly aligns the papers staked on the grip plate. The grip plate 30 is provided in a grip means 33 of the paper positioning unit 88.

A folding means 151 which folds the papers stapled by the stapler unit 84 includes folding rollers 89 and 91, a folder motor 108 driving the folding rollers 89 and 91, and a pusher motor 104 driving a knife 87*a* of a protrusion unit 87.

In the aforementioned paper binding system, once the papers ejected from a main body of a copier move between the paper moving guides 81 and 82, the upper roller 86 and the lower roller 85 rotate so that the papers move along a paper stack guide 83 and are stacked on the grip plate 30 of the grip means 33 in the paper positioning unit 88.

The grip plate 30 moves along with the jogger 61 by driving of the jogger moving motor 70, and is to staple the papers stacked and gripped on the grip plate by aligning their center part to conform to the stapler unit 84.

After stapling the papers, the grip plate 30 of the grip means 33 in the paper positioning unit 88 exactly grips the papers to move them between the folding rollers 89 and 91. The knife 87*a* in the protrusion unit 87 is then operated to push the papers between the folding rollers, thereby folding the papers.

The folded papers are ejected onto an eject tray 135 and stacked thereon.

Particularly, the grip means 33 is provided at the center of the jogger 61 that can slide up and down along a sliding shaft 32. The jogger 61 is connected with a timing belt 94 for moving the jogger, so as to enable reciprocating motion of a jogger moving frame 60. The timing belt 94 is provided in the jogger moving frame 60.

A stack guide 21 which is in contact with the stacked papers is fixed to the jogger moving frame 60. A slit 8 is formed at the center of the stack guide so that the grip plate 30 of the grip means is protruded and slid by movement of the jogger.

The grip means that can move the grip plate along the stack guide includes a worm gear 22 and a worm wheel 24 connected with the grip motor 10, a cam 20 rotating by the worm gear and the worm wheel, and the grip plate 30 moving up and down in accordance with rotation of the cam 20. The grip plate 30 is fixed to the cam so as to move up and down, i.e., in a vertical direction of the stack guide (arrow 'b' of FIG. 2). The grip plate is provided with a return spring 31 so as to naturally drop by load in accordance with rotation position of the cam. The grip plate is connected with the jogger 61.

The operation of the paper binding system of the image forming apparatus is performed by initiating the system and determining whether jam or error of the papers occurs in the paper moving means 150, the paper positioning unit 88, and the folding means 151. The jam or error of the papers is determined by various sensor signals of a central processing unit (CPU). If no jam or error of the papers occurs, the main body of the copier is driven to move the papers to the paper moving means 150.

Once the papers move to the paper moving means 150, the jogger moving motor 70 is driven to move the jogger 61 in a direction of an arrow 'a'.

Meanwhile, the CPU determines the length of the moving papers by means of signals of a first conveyer sensor 122 and a second conveyer sensor 123. Then, the paper moving path formed in the inlet stack guide 83 is changed by an on/off signal of the conveyer switch solenoid 111 so that the papers move.

Once the papers move, the paddle motor 42 and a paddle aligning motor 107 are driven to rotate the paddle and at the same time align the papers in horizontal and vertical directions. Thus, the papers are temporarily stacked on the grip plate 30.

Once a predetermined number of papers are stacked on the grip plate, the grip means 33 is driven to grip the papers stacked on the grip plate.

The gripped papers are stapled by the stapler unit 84 and then the grip plate moves to the folding roller to place the stapled papers in a folding position. The movement position of the grip plate is determined by the movement position of the jogger 61.

Subsequently, a gap of the folding roller is adjusted in comply with the thickness of the folding papers. A grip state of the grip plate that grips the papers is released.

The pusher motor 104 is then driven to push the knife 87*a* to the folding position of the papers so that the papers are pushed to the folding roller and at the same time the folding roller is operated. The papers passed through the folding roller are ejected onto the eject tray 135.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Figure 1:
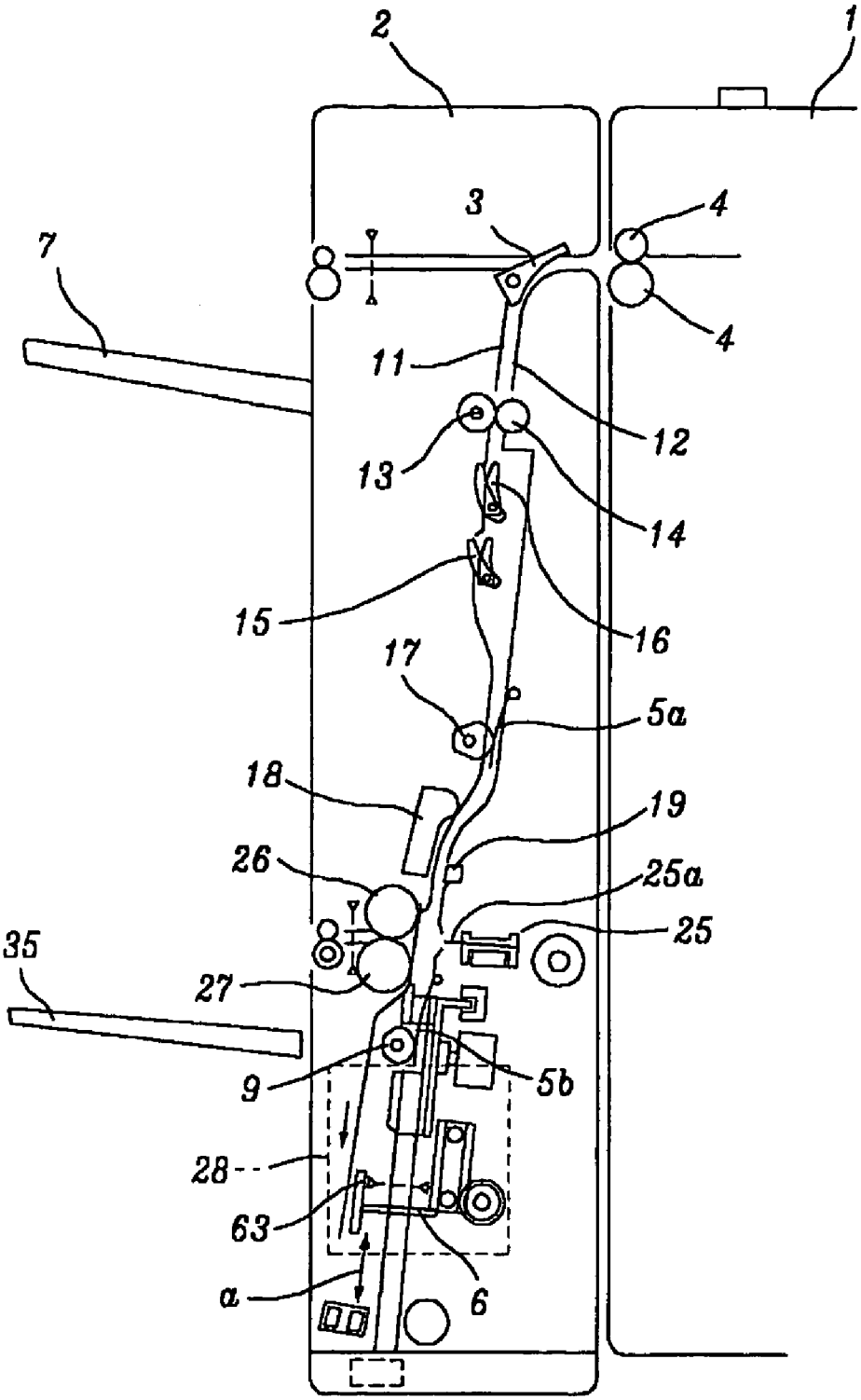
FIG. 1 illustrates a structure of a related art paper binding system of a copier.

Reference will now be made in detail to the preferred embodiments of the present invention, examples of which are illustrated in the accompanying drawings.

A paper binding system of an image forming apparatus is characterized in that it includes a paper moving means 150 moving papers ejected from the image forming apparatus, a paper positioning unit 88 temporarily receiving the papers moved from the paper moving means and positioning them, a stapler unit 84 stapling the papers received in the paper positioning unit, a folding means 151 folding the stapled papers, and an eject tray 135 receiving the papers finished through the stapler unit and/or the folding means, wherein the image forming apparatus includes a grip means moving the papers to a binding position in a state where it grips the papers and releasing the grip state of the papers when the papers are positioned in the binding position, and the folding means includes folding rollers of which distance is adjusted by the thickness of the binding papers.

Particularly, the paper positioning unit includes a jogger 61 that moves by means of a sliding means, the grip means is provided in the jogger and includes a cam means, a return spring 31, and a grip plate 30 having a paper grip part 30*b*, the grip plate is pushed up to an upper part by rotation of the cam means and descends by load of the grip plate and the return spring, and the papers are gripped and supported between the paper grip part 30*b* of the descended grip plate and the jogger 61.

The paper positioning unit further includes a stack guide 21 that covers the jogger, the stack guide being provided with a slit 8 at the center, a part of the grip plate 30 and the paper grip part 30*b* being protruded through the slit, the protruded grip plate moving along the jogger, and the papers being gripped between the stack guide and the paper grip part of the grip plate.

The sliding means of the jogger is fitted into two sliding shafts 32 so that the jogger can slide up and down.

The jogger is fixed to a timing belt 43 for moving the jogger and is slid up and down by the timing belt, the timing belt being provided in a jogger moving frame 60.

The cam means includes a worm gear 22 rotating a worm wheel shaft 23, a cam 20 fixed to the worm wheel shaft 23, and a protrusion pin 20*a* protruded on the cam spaced apart from the central shaft of the worm wheel shaft, the protrusion pin being formed to push the grip plate up in accordance with a rotational position of the cam.

The center part of the grip plate has a curved shape having a predetermined step part which is in contact with the protrusion pin to push the grip plate up.

A method for controlling a paper binding system of an image forming apparatus includes the steps of a) moving papers from a paper moving means to a paper positioning unit, b) gripping, in the paper positioning unit, the moved papers, c) stapling, in a stapler unit, the papers gripped by the paper positioning unit, d) moving the papers stapled by the stapler unit to a folding position of a folding means by moving the paper positioning unit, e) releasing a grip state of the stapled papers by driving the paper positioning unit, f) folding the stapled papers by driving the folding means, and g) ejecting the folded papers onto an eject tray.

It is to be understood that both the foregoing general description and the following detailed description are exemplary and explanatory and are intended to provide further explanation of the invention as claimed.

Figure 2:
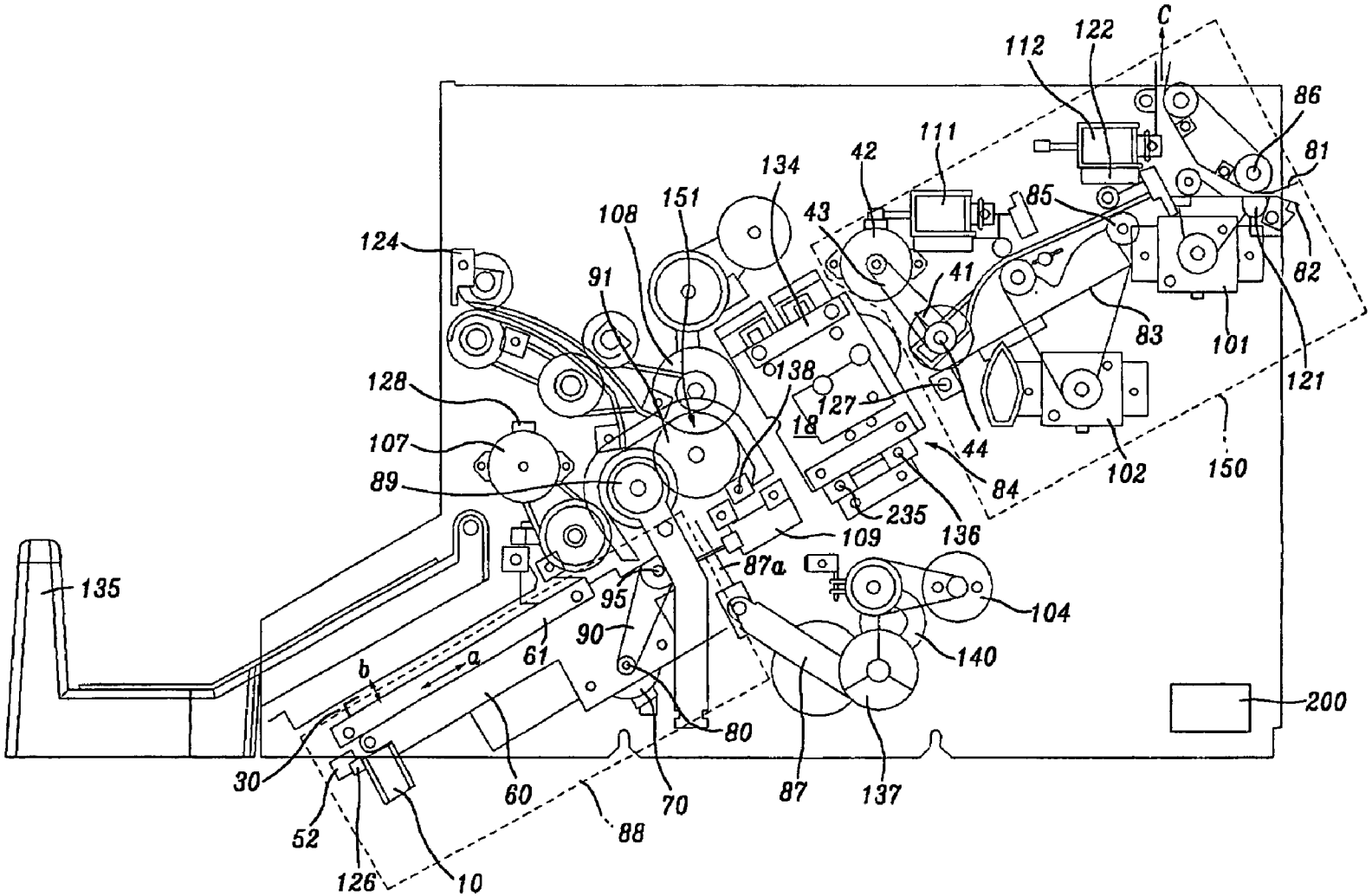
FIG. 2 illustrates a structure of a paper binding system of a copier according to the present invention.

A paper binding system of an image forming apparatus according to the present invention, as shown in FIG. 2, includes a paper moving means 150 moving papers ejected from the image forming apparatus, a paper positioning unit 88 temporarily stacking the ejected papers on a binding position and positioning them, a stapler unit 84 stapling the stacked papers, a folding means 151 folding the stapled papers, and an eject tray 135 outwardly ejecting the folded papers.

The paper moving means 150 includes a lower roller 86, a conveyer motor 102, and a paddle motor 42. The lower roller 86 leads the papers moving from the image forming apparatus to the binding system by driving an inlet motor 101 by means of a paper sensing signal of an inlet sensor 121 formed in paper moving guides 81 and 82. The conveyer motor 102 rotates an upper roller 85 to move the papers led to the binding system to an inlet stack guide 83. The paddle motor 42 aligns the papers moving through the inlet stack guide. The paper moving means 150 further includes an inlet solenoid 112 near the upper roller 85. The inlet solenoid 112 moves the papers to the inlet stack guide 83 or ejects the papers ejected from the image forming apparatus in a direction of 'C' without finishing the papers so as to stack the papers on an outer tray. The paper moving means 150 further includes a first paper conveyer sensor 122, a second paper conveyer sensor 123, and a paper conveyer switch solenoid 112. The first and second paper conveyer sensors 122 and 123 are provided at upper and lower ends of the inlet stack guide. The paper conveyer switch solenoid 112 is provided to move the papers by selecting a plurality of paper moving paths (not shown), which are formed in the inlet stack guide, in accordance with the size of the papers. The paper conveyer switch solenoid 112 is turned on/off depending on whether the papers moving from the image forming apparatus are short or long, so as to select the paper moving path formed in the inlet stack guide. The papers moving along the inlet stack guide 83 are sensed by a conveyer paddle sensor 127. The paddle motor 42 is driven by a signal of the conveyer paddle sensor 127 so that the paddle 41 connected with a paddle driving timing belt 43 is rotated. The moving papers are aligned by rotation of the paddle 41. The first and second paper conveyer sensors 122 and 123 check the moving distance and time of the papers when they sense the papers, thereby checking whether jam of the papers has occurred.

Figure 6:
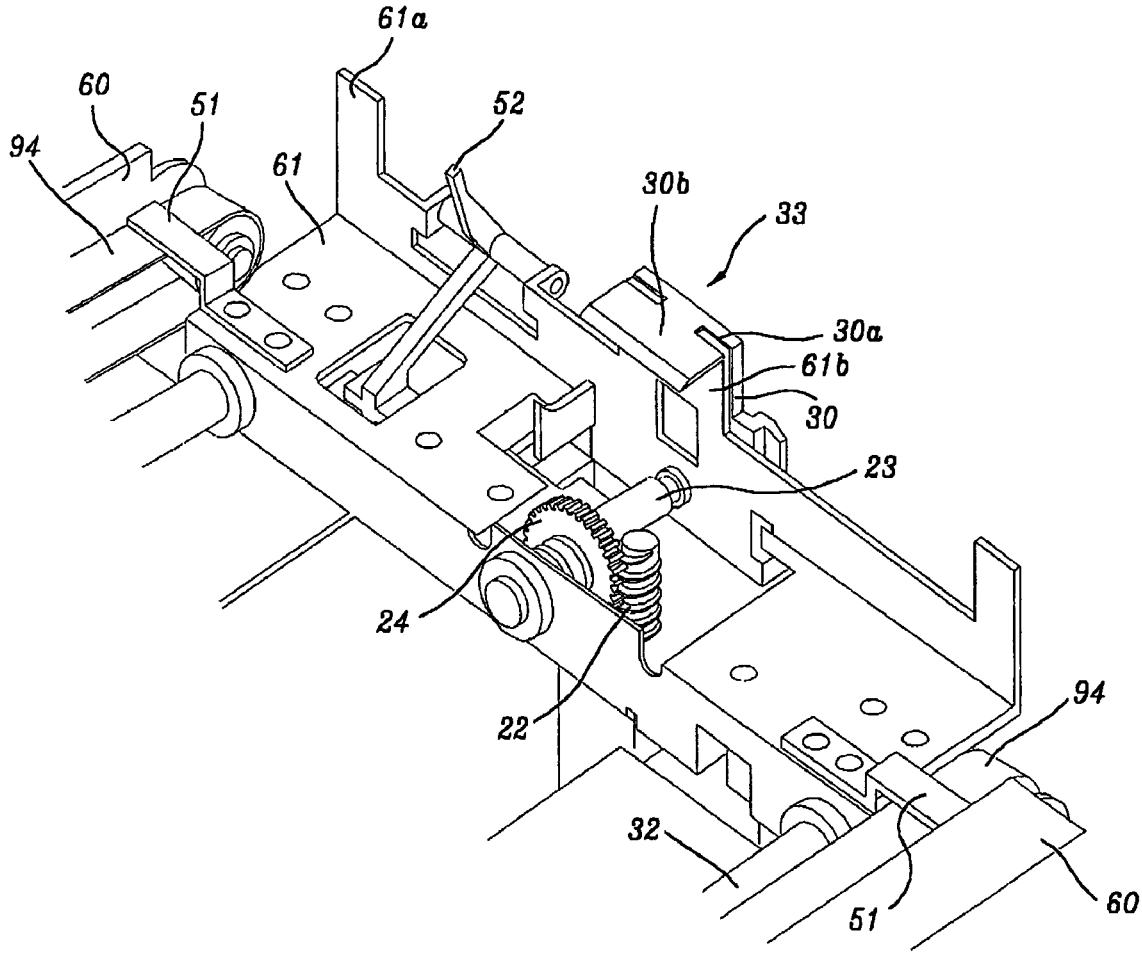
FIG. 6 is a perspective view of a main part when viewing a gripper of a paper binding system according to the present invention at a top after removing a stack guide.
Figure 7:
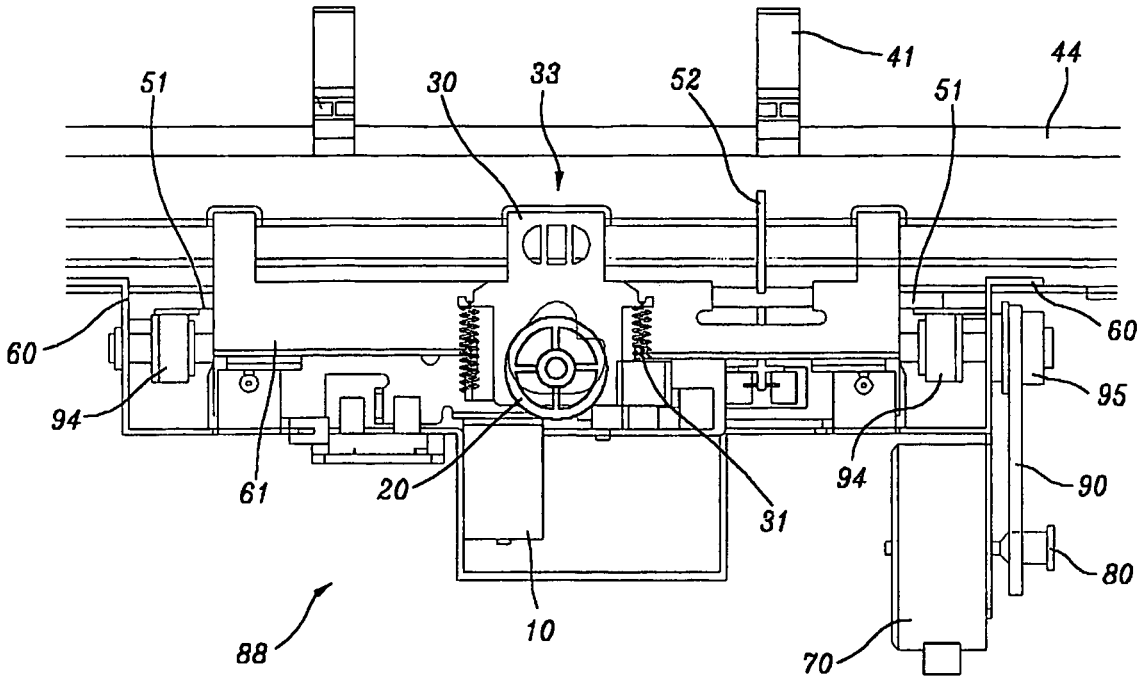
FIG. 7 is a sectional view of a main part illustrating a structure of a paper binding system according to the present invention.

Meanwhile, the paper positioning unit 88 temporarily receives the papers moving from the paper moving means and positions the papers. The paper positioning unit 88 includes a grip motor 10 driving a grip plate 30, a jogger moving motor 70 driving a jogger 61, and a horizontal aligning motor 109 driving a paper horizontal aligning unit (not shown) that uniformly aligns the papers staked on the grip plate in a horizontal direction. Once a predetermined number of papers are stacked on the grip plate 30, the grip plate 30 descends to stably grip the papers without scattering. The grip plate 30 moves to a proper position so that the gripped papers are stapled by the stapler unit 84 and the stapled papers are folded by the folding means 150. The aforementioned paper positioning unit, as shown in FIGS. 6 and 7, includes a sliding shaft 32 that can slide the jogger 61 provided with the grip plate 30 in a moving direction of the papers, i.e., up and down (in a direction of an arrow 'a'). A jogger moving frame 60 is provided in parallel with the sliding shaft 32. A timing belt 94 for moving the jogger is provided in the jogger moving frame 60 along the sliding shaft 32 and is fixed to the jogger 61 by a clamp clip 51.

The timing belt 94 moves by means of a rotational force of a jogger belt 90 fitted between a jogger moving pulley 95 and a jogger motor pulley 80. The jogger moving motor 70 connected with a shaft of the jogger motor pulley 80 can be rotated in forward and reverse directions and is controlled to reciprocate the timing belt 94. A grip means 33 is provided at the center of the jogger 61. The grip means 33 includes a worm wheel 24 fixed to a wheel shaft 23, a worm gear 22 rotating the worm wheel 24, a cam 20 fixed to the end of the wheel shaft 23, the grip plate 30 moving up and down by rotation of the cam 20, and a return spring 31 fixed to the grip plate 30. The worm gear 22 is driven by the grip motor 10. A protrusion pin 20*a* is provided at the circumference of the cam 20, and the grip plate 30 moves by means of the protrusion pin 20*a* in a vertical direction (arrow 'b') with respect to the jogger 61. A guide groove 30*a* is provided in the grip plate 30 in such a way that it is fitted into a guide 61*b* of a support plate 61*a*. The support plate 61*a* is provided in the jogger 61. The grip plate 30 moves along the guide 61*b*. A paper grip part 30*b* is provided at an upper portion of the grip plate 30 and extends in a direction perpendicular to the grip plate. Thus, the paper grip part 30*b* faces a base of the jogger 61. A curved groove 30*c* is provided in a main body of the grip plate 30.

Figure 3:
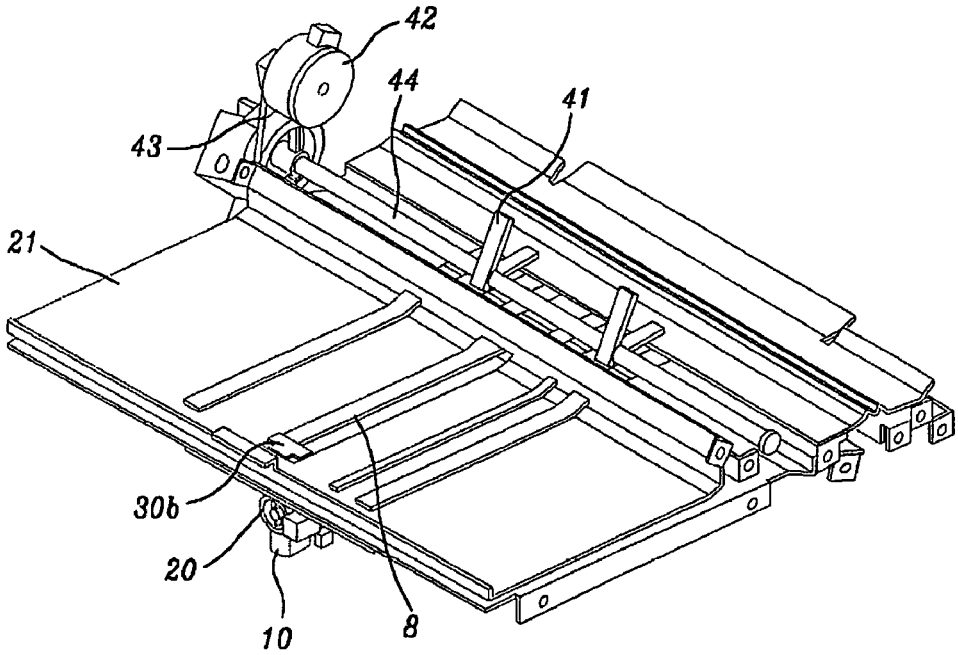
FIG. 3 is a perspective view of a main part when viewing a paper binding system of a copier according to the present invention at a top.
Figure 4:
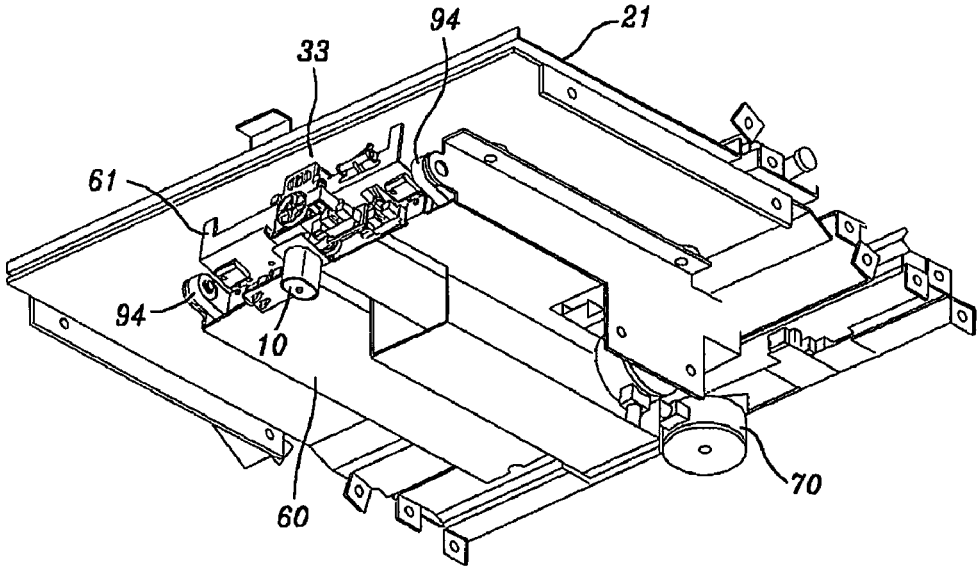
FIG. 4 is a perspective view of a main part when viewing a paper binding system of FIG. 3 at a bottom.
Figure 5:
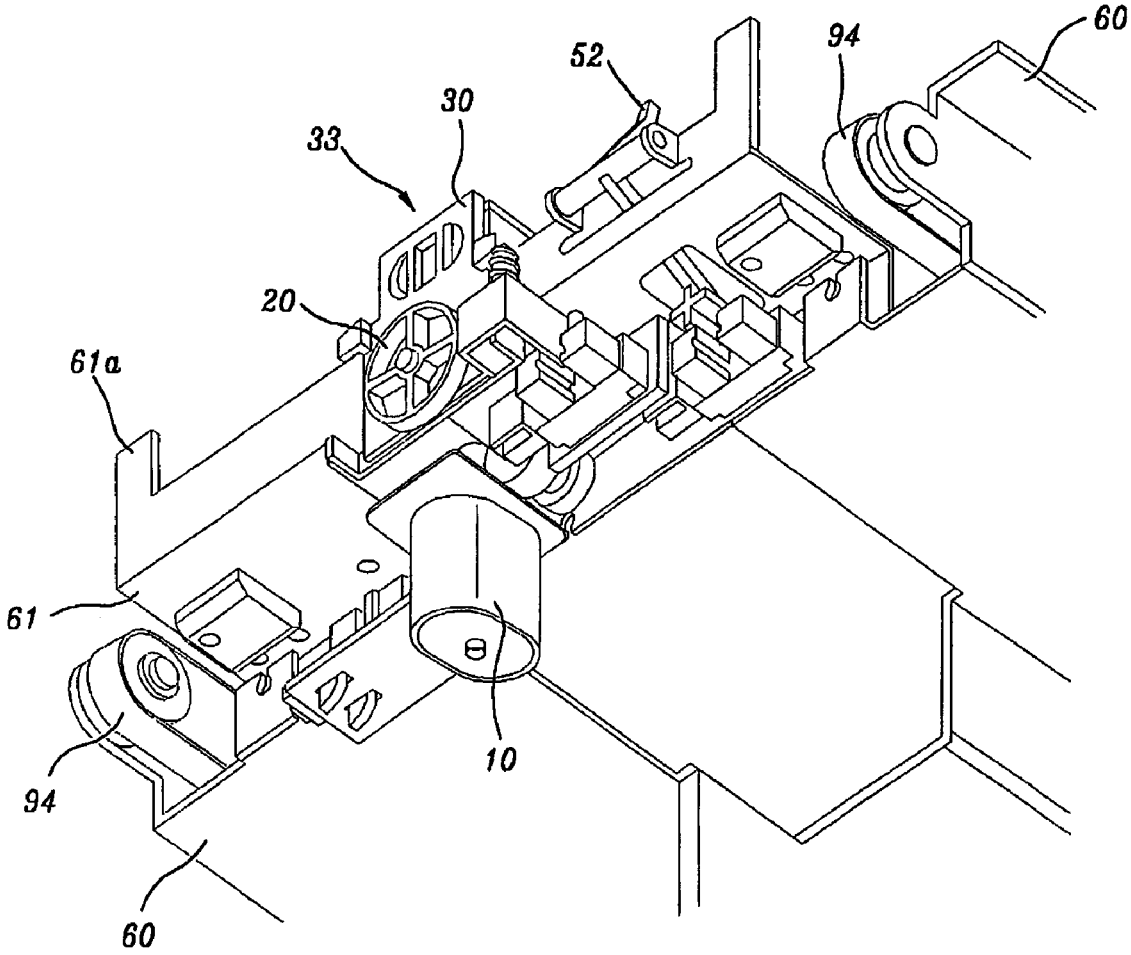
FIG. 5 is a perspective-view of a main part when viewing a gripper of a paper binding system according to the present invention at a bottom.
Figure 8A:
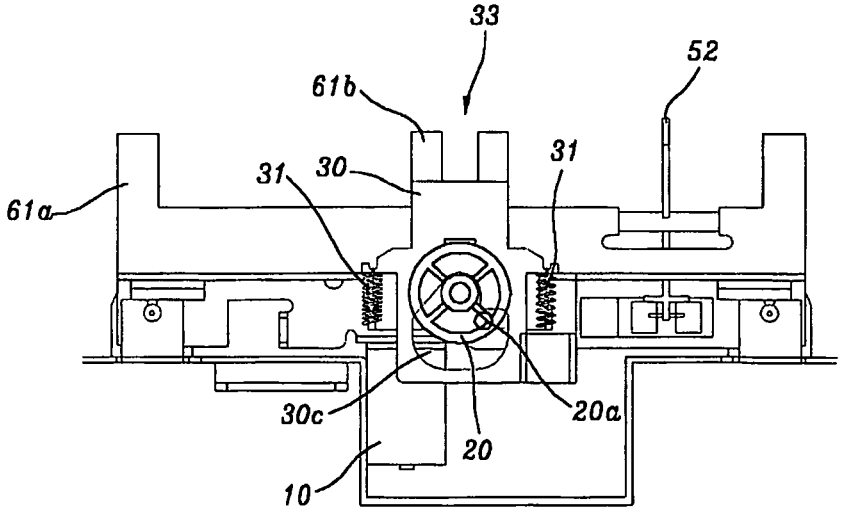
FIGS. 8*a* to 8*c* illustrate the operation of driving a grip means provided in a paper binding system according to the present invention.

The curved groove 30*c* of the grip plate 30 is to push the grip plate 30 up only in a position where the protrusion pin 20*a* ascends by means of rotation of the cam 20. Once the protrusion pin 20*a* descends by means of rotation of the cam, the grip plate can descend by load itself. The grip plate 30 serves to naturally grip the papers descending in a sliding direction of the jogger 61 and at the same time is provided with the return spring 31 to maintain the grip state. The return spring 31 is fixed to a main body of the jogger 61 and a spring fixing part 30*d* of the grip plate. The operation of the grip means 33 of the present invention will be described in more detail with reference to FIG. 3 and FIGS. 6 to 9. FIG. 8A illustrates a state where the grip plate 30 of the grip means 33 descends by means of load itself. That is, FIG. 8 illustrates a state where the paper grip part 30*b* extended at the upper part of the grip plate descends toward the stack guide 21 on the jogger to grip the papers as will be apparent from a plane view of FIG. 3. Therefore, the papers are gripped between the paper grip part 30*b* and the stack guide 21. In a state where the paper grip part 30*b* grips the papers, the grip motor 10 is driven in such a way that the protrusion pin 20*a* is positioned so as not to be caught in a step part of the curved groove 30*c*, thereby rotating the cam 20.

Figure 8B:
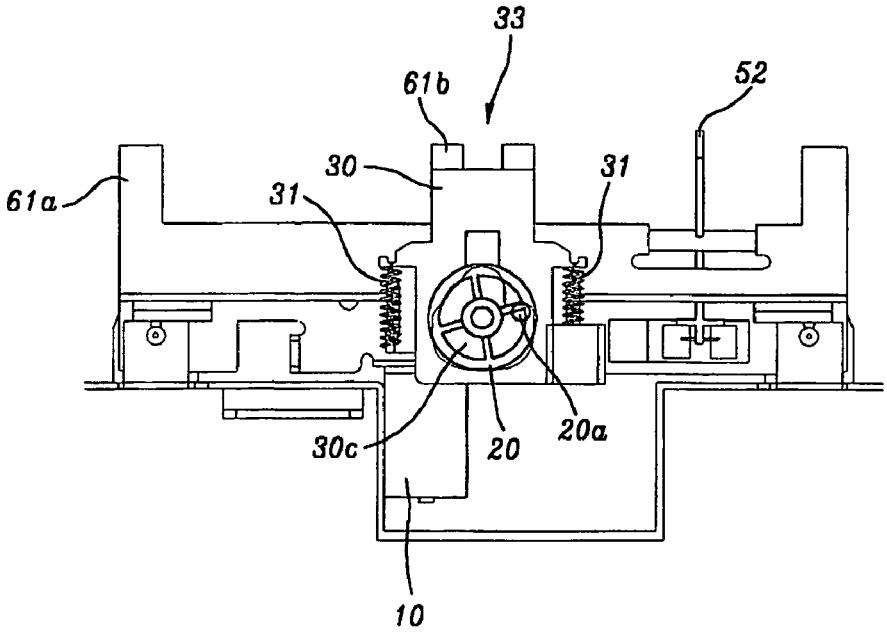
Figure 8C:
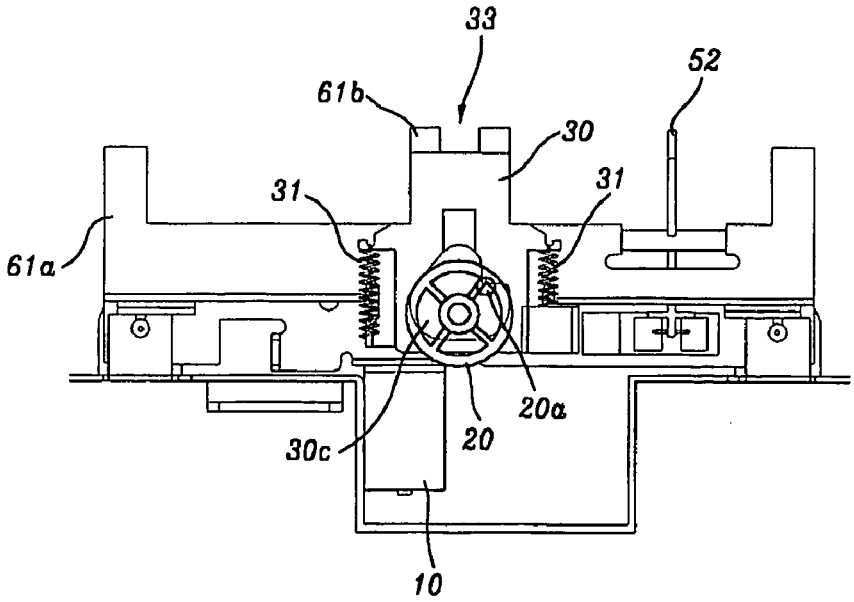
Figure 9:
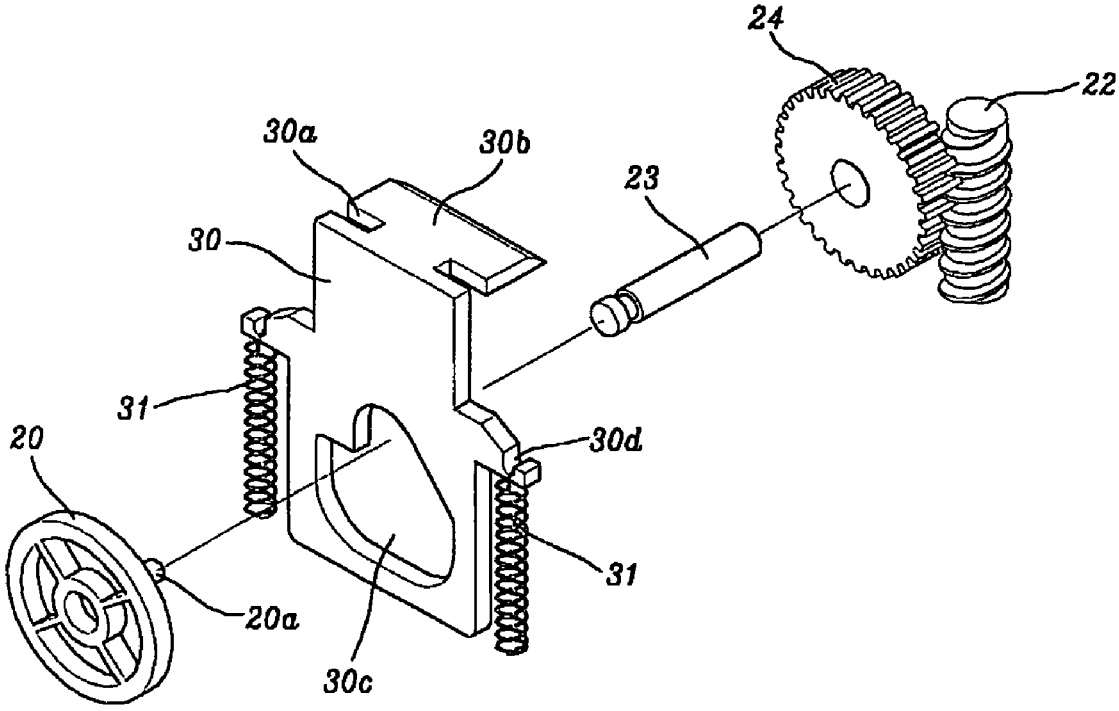
FIG. 9 is an exploded perspective view illustrating a structure of a grip plate and a cam in a grip means provided in a paper binding system according to the present invention.

To release the grip state of the papers after finishing binding of the papers by moving the paper positioning unit in a state where the paper grip part 30*b* grips the papers, as shown in FIG. 8B, the grip motor 10 is rotated so that the protrusion pin 20*a* of the cam 20 can push the step part of the curved groove 30*c* of the grip plate 30 up. The grip plate 30 pushed by the cam 20 moves along the guide 61*b* in the support plate 61*a* of the jogger 61. FIG. 8C illustrates a state where the grip plate 30 is pushed up to the maximum range by driving of the cam 20. In this state, if the cam 20 is rotated, the protrusion pin 20*a* is detached from the step part of the curved groove, thereby resulting in that the grip plate 30 descends as shown in FIG. 8A. Therefore, in the process of stacking the papers on the stack guide 21 of the paper positioning unit 88, the grip state of the papers is released in a state where the grip plate 30 is pushed up as shown in FIG. 8C. In the process of finishing the papers, the grip state of the papers is released in a state where the grip plate 30 descends to grip the papers stacked on the stack guide 21 as shown in FIG. 8A.

Meanwhile, the paper positioning sensor 52 provided near the grip plate outputs a signal that moves the jogger 61 in accordance with the size of the binding papers or senses jam of the papers in the paper positioning unit. A grip sensor 126 outputs a signal that drives the grip motor 10 in accordance with the number of papers stacked on the grip plate 30.

The stapler unit 84 includes a stapler head 18, a first stapler sensor 235, a second stapler sensor 136, and a stapler groove sensor 134. The stapler groove sensor senses whether the position of the stapler is exact while the first and second stapler sensors sense whether the respective staplers are provided with an iron core.

The aforementioned stapler unit staples the papers gripped in the paper positioning unit.

The stapler unit 84 is constructed as shown in FIGS. 12 to 18 so that it can easily be detached from the binding system.

The detachable stapler unit 84 is fixed to a slide rail 310. The slide rail 310 is fitted into a fixed bracket 330 for the slide rail, which is fixed to a fixed base 302 for the stapler unit, so that the slide rail can slide along the bracket 330. When the stapler unit is fixed to the fixed base 302, a guide is provided to determine the fixing position.

The slide rail is formed by overlapping a plurality of plates. A ball bearing is fitted into a contact portion between the respective plates. The most upper plate is fixed to the stapler unit while the lowest plate is fitted into the fixed bracket so as to enable sliding.

The guide includes a guide bracket fixed to the fixed base 302 in parallel with the fixed bracket, and first and second guide blocks respectively fixed to front and rear sides at the upper part of the stapler unit so as to slide along the guide bracket.

A plug connector is provided at a side of the stapler unit, and a receptacle connector is provided at a side of the fixed base. The plug connector is fixed to or detached from the receptacle connector in accordance with fixation or detachment of the stapler unit.

The structure and operation of the stapler unit according to the present invention will be described in more detail with reference to FIGS. 12 to 18.

The stapler unit 84 is constructed in such a way that it can externally be detached from the fixed base 302. This is to facilitate replacement of the iron core of the stapler unit and its repair.

Figure 12:
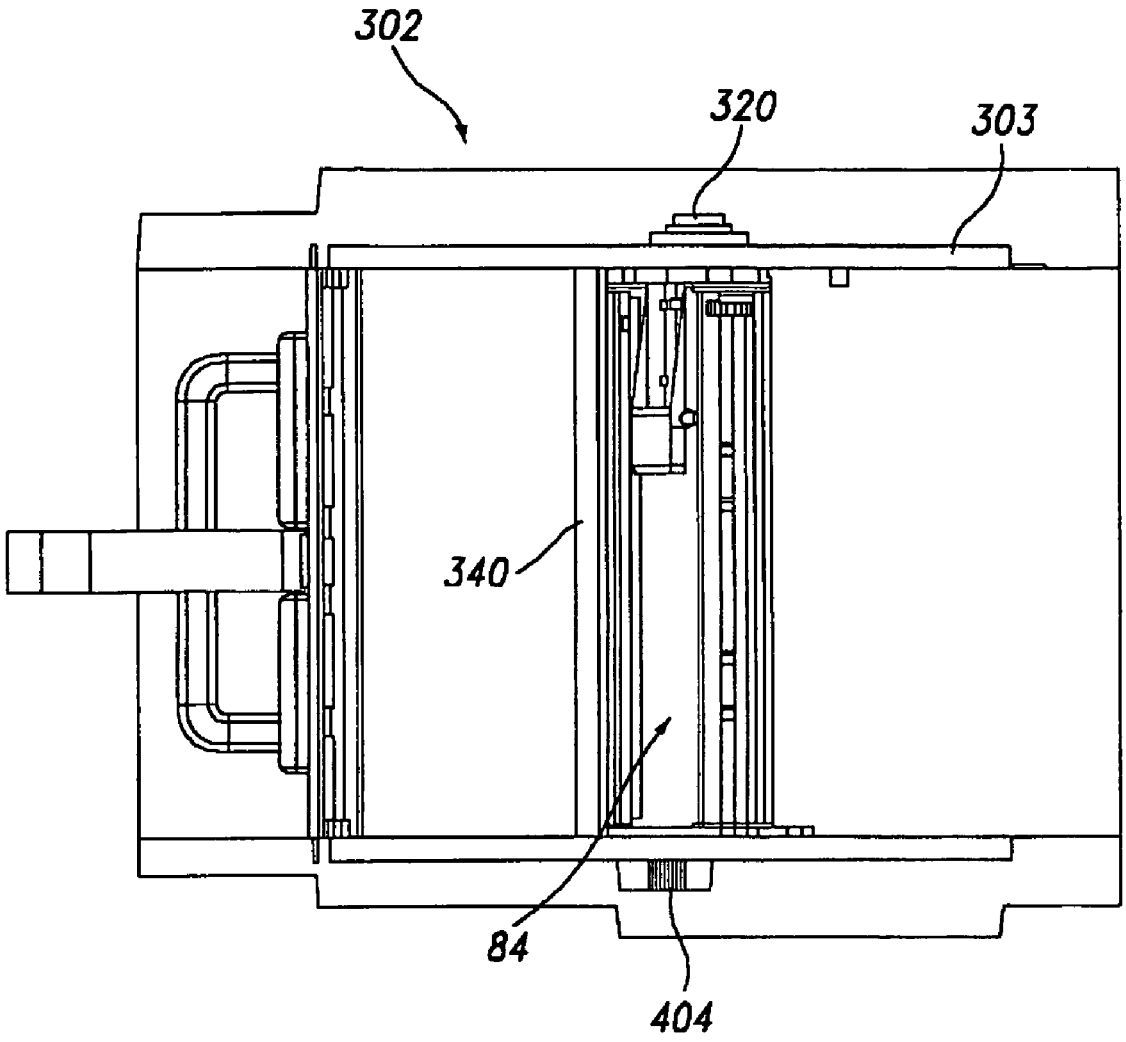
FIG. 12 is a plane view illustrating a state where a stapler unit is fixed to a stapler unit base of a paper binding system according to the present invention.
Figure 13:
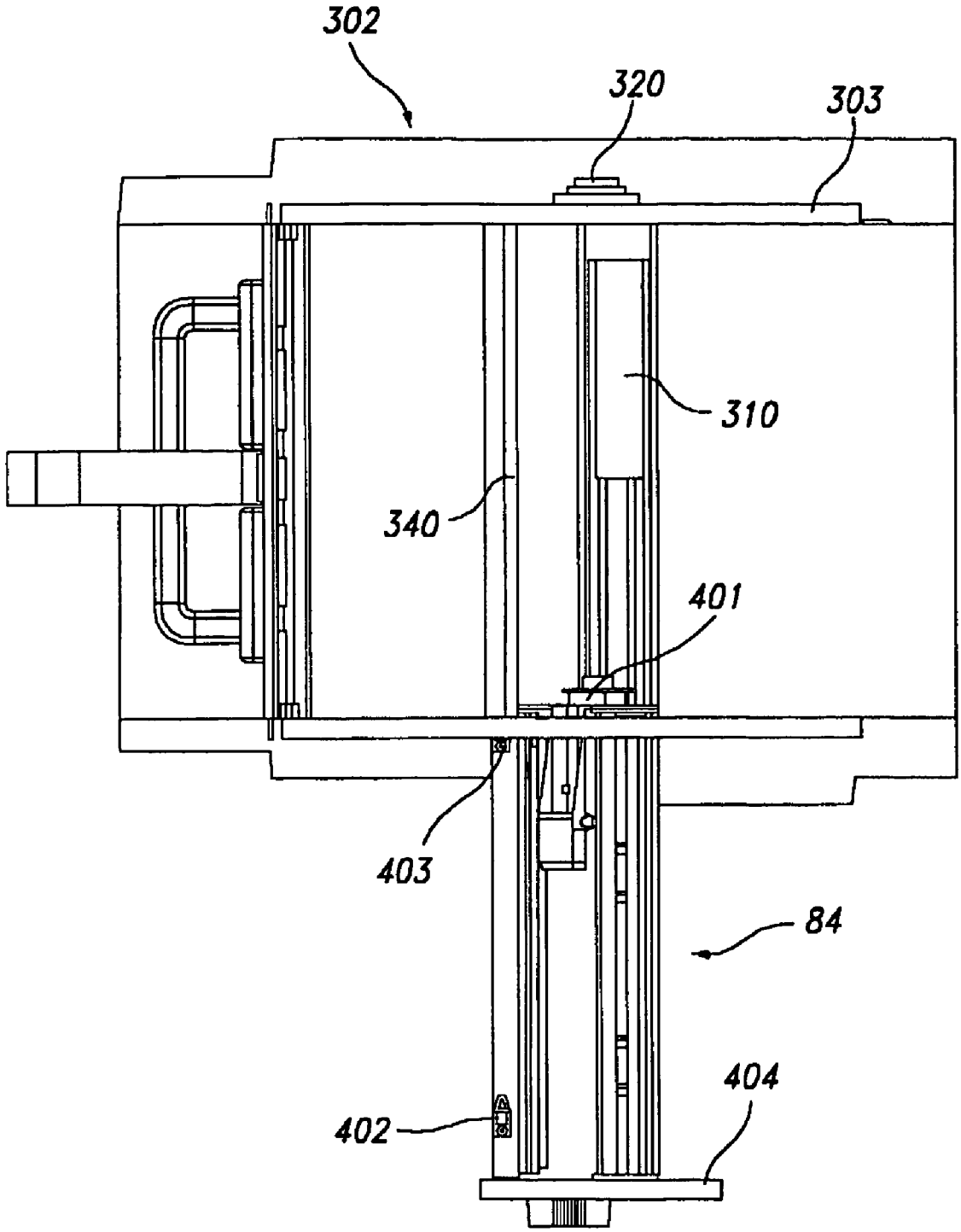
FIG. 13 is a plane view illustrating a state where a stapler unit is detached from a stapler unit base of a paper binding system according to the present invention.
Figure 14:
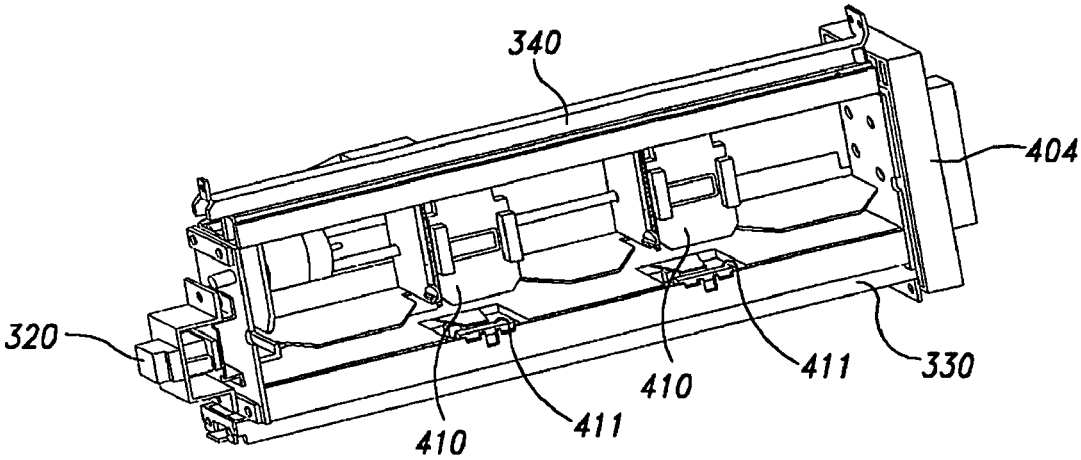
FIG. 14 is a perspective view illustrating a stapler unit of the present invention.
Figure 15:
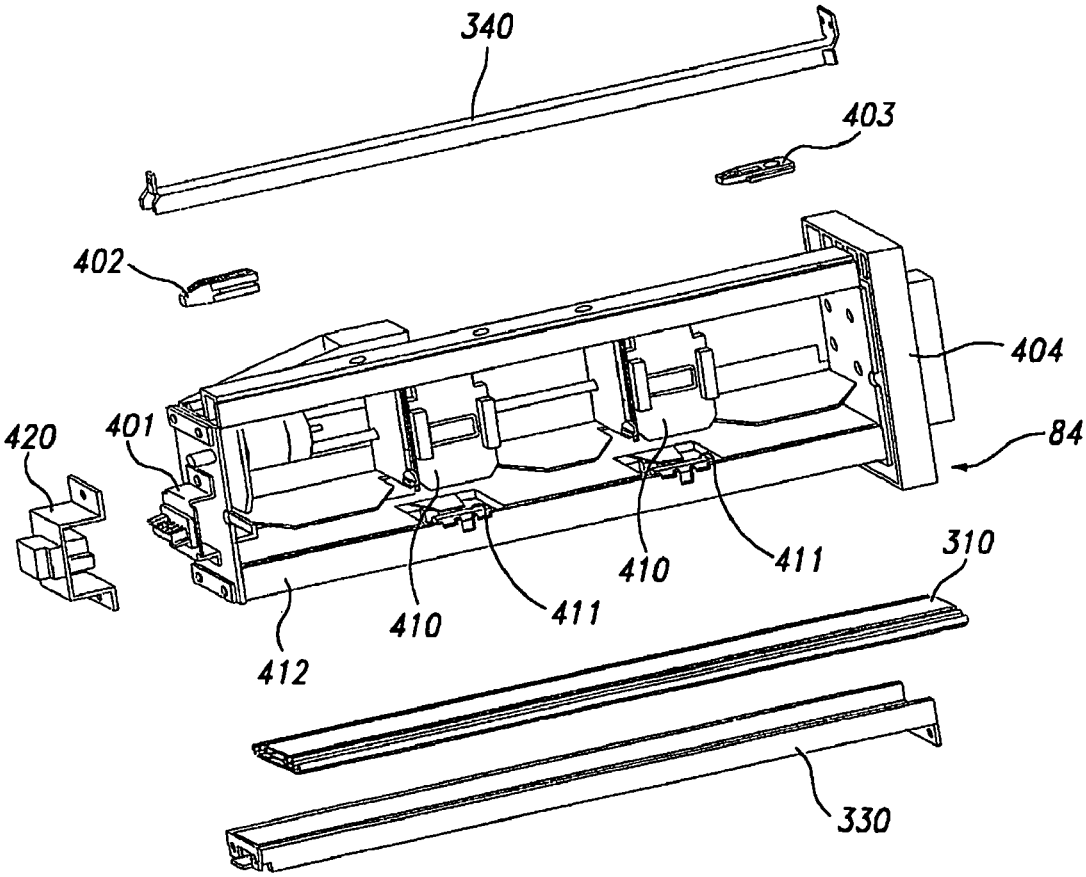
FIG. 15 is an exploded perspective view of a stapler unit of the present invention.
Figure 16:
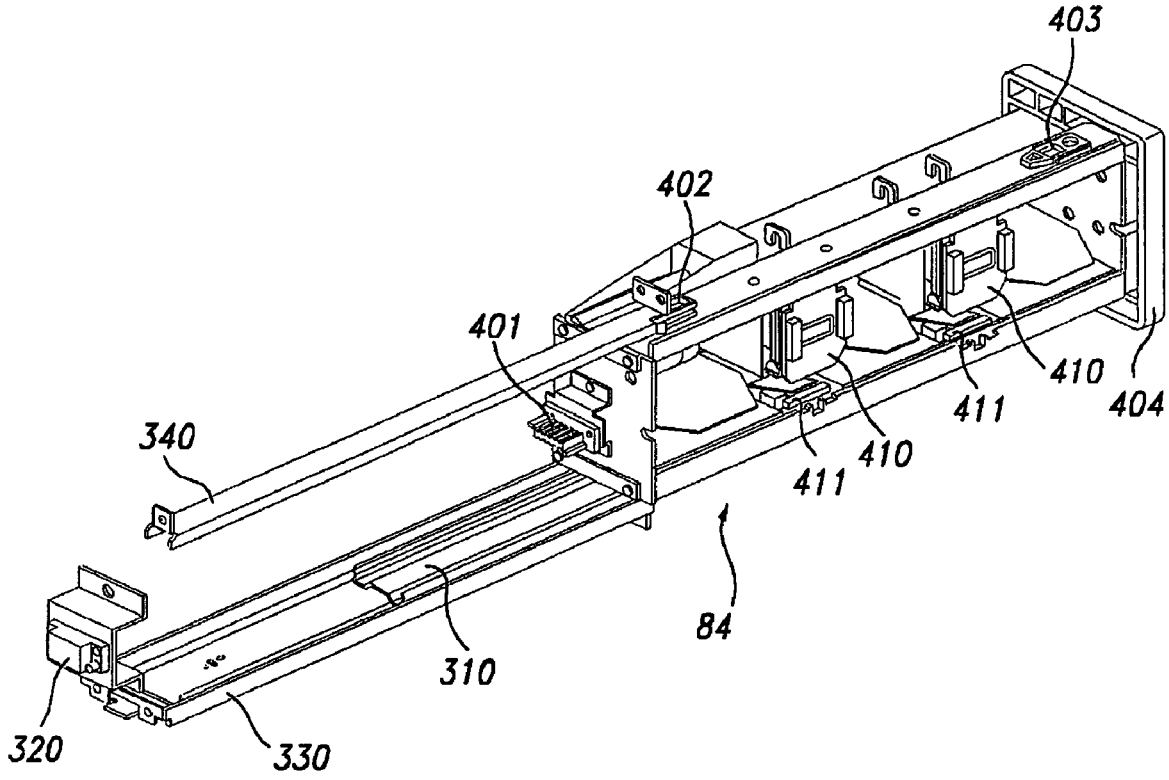
FIG. 16 illustrates the operation of a stapler unit of the present invention.
Figure 17:
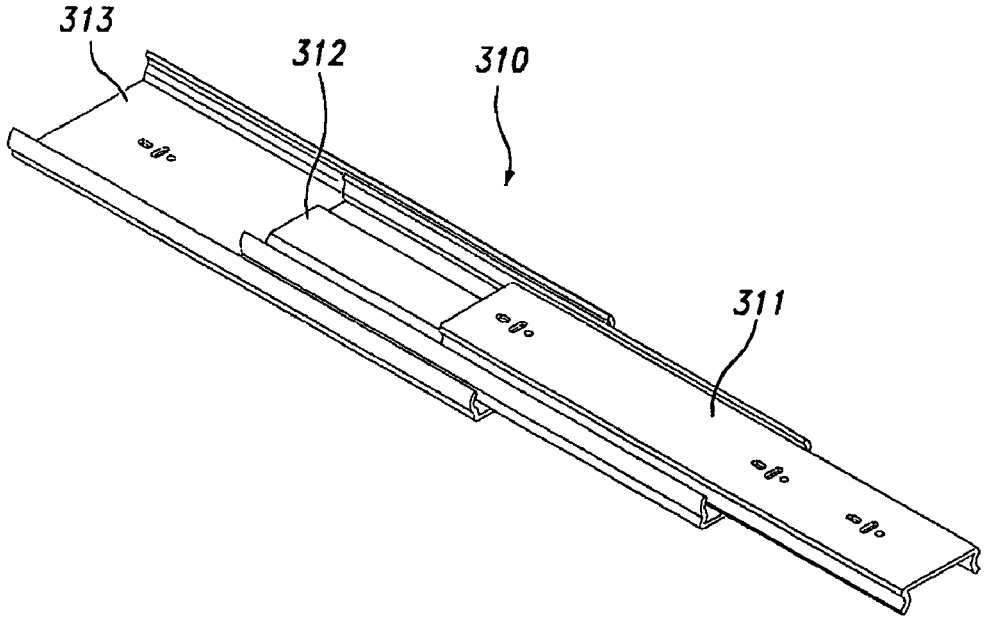
FIG. 17 illustrates a structure of a slide rail of a stapler unit according to the present invention.
Figure 18:
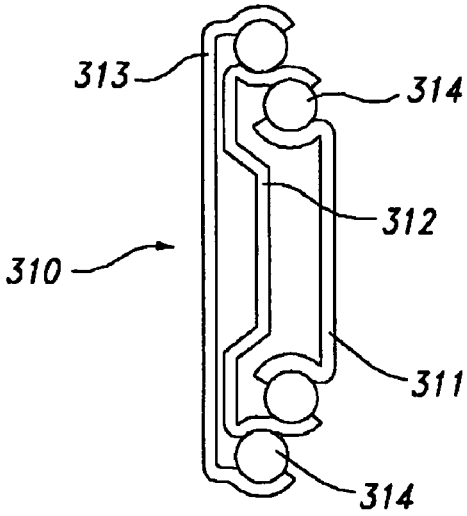
FIG. 18 is a side view of a slide rail of FIG. 17.

The slide rail 310 is fixed to the lower part of the stapler unit 84, as shown in FIG. 12, and can externally move to replace the iron core in a state where it is fixed to the fixed base 302. Also, the slide rail 310 moves along the fixed bracket 330 fixed to a support 303 of the fixed base 302.

When the stapler unit is fixed to the fixed base 302, the guide bracket 340 is provided in parallel with the fixed bracket to exactly guide the fixing position of the stapler unit. The first and second guide blocks 403 and 402 are respectively provided at front and rear sides of the upper part of the stapler unit so as to slide along the guide bracket 340.

The plug connector 401 is fixed to one end of the stapler unit 84 to transmit the power and various information signals to the stapler unit 84. The plug connector 401 is fitted into the receptacle connector 320 which is provided at the support 303 of the fixed base, so that the power and various information signals are transmitted to the stapler unit 84.

A stapling apparatus of the present invention includes the stapler unit 84, the receptacle connector 320, the slide rail 310, the fixed bracket 330, the guide bracket 340, and two guide blocks 402 and 403. The stapler unit 84 includes a stapler 410, a clinch 411, a stapler handle cover 404, a stapler frame 412, and the plug connector 401.

The stapler unit 84 is operated by a stapler driving signal transmitted from the main body of the binding system in a state where the receptacle connector 320 is fixed to the plug connector 401. The iron core (not shown) in the stapler unit is bent inwardly by the clinch 411 provided to oppose the stapler 410, thereby stapling the papers.

The slide rail 310 is fixed to a lower part of the stapler frame 412 and is also fixed to the fixed bracket 330 which is fixed to the support 303 of the fixed base 302.

Particularly, the slide rail 310 is formed by overlapping an upper plate 311, an intermediate plate 312, and a lower plate 313. The ball bearing 314 is interposed between the respective plates so as to enable reciprocating slide operation.

The length of the slide rail 310 can elastically be elongated by forming a multi-plate as above.

The upper plate 311 of the slide rail 310 is fixed to the stapler frame 412, and the lower plate 313 is fixed to the fixed bracket 330.

The front guide block 403 and the rear guide block 402 are provided at the upper part of the stapler unit so as to slide along the guide bracket 340 fixed to the fixed base. Thus, the guide blocks 402 and 403 serve to exactly determine the fixing position of the stapler unit when the stapler unit is fixed to the fixed base.

The receptacle connector 320 is provided at one end of the fixed bracket 330 and can be coupled to the plug connector 401 when the plug connector 401 fixed to the stapler unit moves thereto. The receptacle connector 320 is a terminal that connects the power with the driving information signals of the stapler unit transmitted from the binding system. Also, the receptacle connector 320 is connected to the plug connector 401 to drive the stapler unit 84.

As described above, the stapler unit 84 including the stapler 410, the clinch 411, etc. is constructed in such a way that it can be slid into the binding system using the slide rail 310 of a multi-plate structure. When the stapler unit 84 moves to the fixed base to be fixed thereto, the guide bracket 340 and the guide blocks 403 and 402 are provided to exactly support and fix the position of the stapler unit, thereby greatly improving reliability of the stapling apparatus.

Meanwhile, the folding means 151 includes a folder motor 108, a folder roller sensor 138, and a protrusion unit 87. The folder motor 108 drives folding rollers 89 and 91. The folder roller sensor 138 measures the whole thickness of the gripped papers to adjust the distance between the rollers. The protrusion unit 87 is to push the gripped papers between the rollers so as to fold the papers. The protrusion unit 87 includes a pusher cam 137, a pusher encoder 140, and a pusher motor 104. The pusher cam 137 drives a knife 87*a* when the gripped papers move to the binding position. The pusher encoder 140 controls the pusher length to exactly push the papers to the inlet of the folding rollers. The pusher motor 104 drives the protrusion unit 87.

In particular, when the knife 87*a* pushes the papers to the folding rollers 89 and 91, the grip plate 30 or the paper positioning unit moves at a proper speed so as not to allow the papers to slide from the knife and at the same time releases the grip state of the papers.

Once the papers are pushed between the folding rollers, the stapled papers are folded by half by counter action of the folding rollers rotating in opposite directions, thereby completing binding of the papers. The papers passed through the folding rollers are ejected onto the eject tray 135 and stacked thereon.

Figure 19:
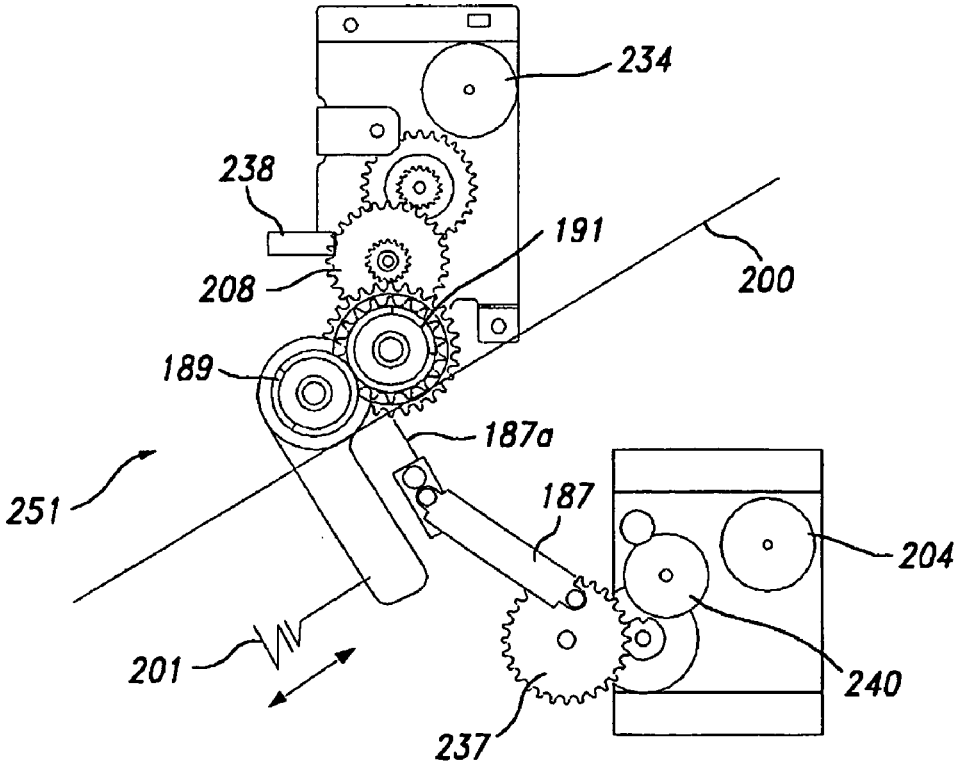
FIG. 19 is a side sectional view illustrating a structure of a folding means provided in a paper binding system of the present invention.

Another structure of the folding means according to the present invention will be described with reference to FIGS. 19 to 21.

In another structure of the folding means, a number of papers or thick papers are easy to move between the folding rollers by adjusting the distance between the folding rollers in accordance with the number of the papers.

The distance between the folding rollers is adjusted by a double structure in which a circular section of a pair of folding rollers 189 and 191 is partially removed. Thus, the papers can move between the folding rollers regardless of the number of the folding papers. Also, this structure of the folding means facilitates folding of the papers by increasing the rolling pressure when folding the papers.

The folding means 251 constructed as above includes a pair of the folding rollers 189 and 191, a folder motor 208, and a folder roller sensor 238. The folding rollers are provided with gaps on the circumference thereof, the gaps having different distances by a predetermined interval. The folder motor 208 provides a rotational force to the folding rollers 189 and 191. The folder roller sensor 238 senses the position of the folding rollers to adjust the distance between the rollers in accordance with the number of folding papers.

The folding means 251 further includes a protrusion unit knife 187*a* and a pusher motor 204. The protrusion unit knife 187*a* is to push the folding position of the papers to move the papers between the folding rollers. The pusher motor 204 provides a driving force to allow the protrusion unit knife 187*a* to move between the folding rollers.

The folding rollers have double circular sections by uniformly removing the circumference of each folding roller by a predetermined interval.

Furthermore, the folding means 251 further includes a pressure means that connects with the shaft of the folding rollers and pressurizes the folding rollers to closely adhere to each other. A spring is used as the pressure means.

Figure 20:
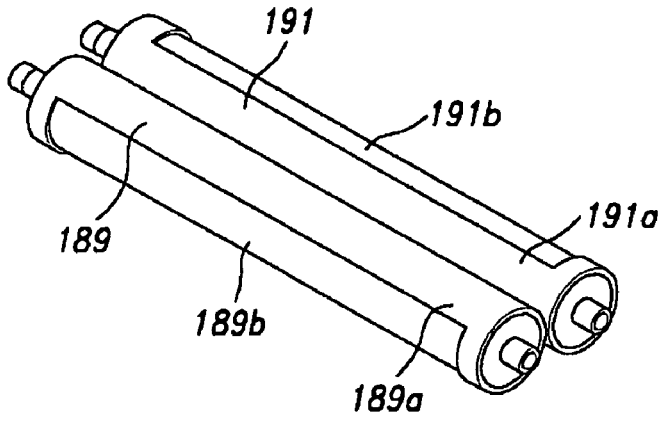
FIG. 20 is a perspective view illustrating a folding roller provided in a folding means of FIG. 19.

Referring to FIGS. 20 and 21, a gap is formed by partially removing the circumference of the folding rollers 189 and 191 at a predetermined thickness, so that the papers having different thickness move between the folding rollers. The gap is obtained by the circumference of a double circle of the respective folding rollers, the double circle having large diameters 189*a* and 191*a* and small diameters 189*b* and 191*b*.

Therefore, if a small number of papers 202 (2 to 5 papers) are provided, the papers move between the large diameters. On the other hand, if a great number of papers (6 to 15 papers) are provided, the papers move between the small diameters.

The folding rollers 189 and 191 are provided with a reduction gear 234 and the folder motor 208. The reduction gear 234 provides the rotational force to the folding rollers. A pressure spring 201 is provided at the shaft of the folding rollers and provides a predetermined pressure to enhance adhesive force between the folding rollers.

The folder roller sensor 138 is provided at the upper part of the folding rollers 189 and 191 and senses the contact position between the large diameters 189*a* and 191*a* and the contact position between the small diameters 189*b* and 191*b*.

If the small number of papers are provided, the folder roller sensor 138 rotates the folding rollers to move the papers between the large diameters 189*a* and 191*a*. If the great number of papers are provided, the folder roller sensor 138 rotates the folding rollers to move the papers between the small diameters 189*b* and 191*b*.

The protrusion unit knife 187*a* is provided at the lower part of the folding rollers and is driven in a straight direction to move the papers between the folding rollers after pushing the folding boundary of the papers 202. The knife 187*a* is driven by the pusher encoder 140 and the pusher cam 237 which are connected with the pusher motor 104.

The protrusion unit 187 is provided between the knife 187*a* and the pusher cam 137. The protrusion unit moves the knife 187*a* in a straight direction by an eccentric amount of the pusher cam, the eccentric amount being caused by rotation of the pusher cam.

Once the papers 202 move to the folding means 251, the folder roller sensor 238 senses the folding rollers and transmits a position signal to the CPU 200. The CPU 200 applies a driving signal to the folder motor 208 in accordance with the number of the papers and adjusts the position of the folding rollers 189 and 191.

Figure 21A:
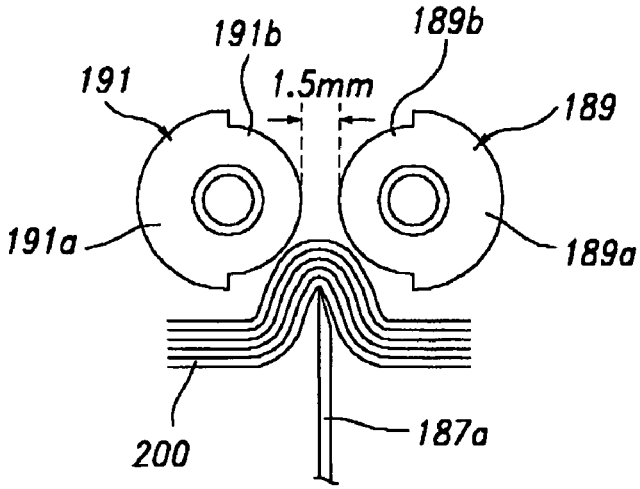
FIGS. 21*a* and 21*b* are perspective views illustrating a state where papers move to a folding roller of the present invention.
Figure 21B:
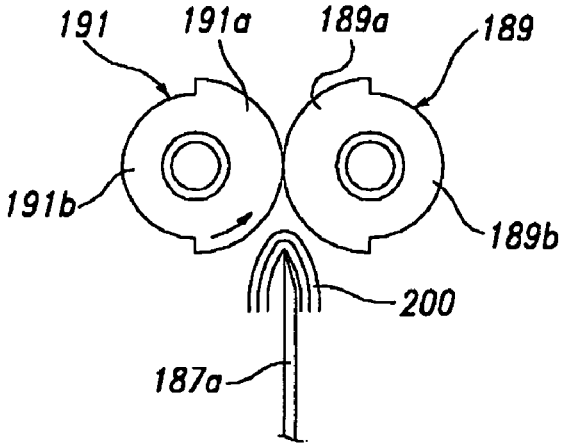

In other words, as shown in FIG. 21B, if the small number of the papers are provided, the large diameters 189*a* and 191*a* of the folding rollers are rotated in a position that can pressurize the folding means of the papers, in accordance with the sensing signal of the folder roller sensor 138. As shown in FIG. 21A, if the great number of the papers are provided, the small diameters 189*b* and 191*b* of the folding rollers provided with the gaps are rotated in a position that can pressurize the folding means of the papers.

Subsequently, once the folding boundary of the papers is positioned between the folding rollers, the pusher motor 204 is driven to transmit the rotational force to the pusher encoder 240 and the pusher cam 237 sequentially. The knife 187*a* connected with the protrusion unit 187 moves by means of action of the pusher cam to push the papers between the folding rollers 189 and 191.

Figure 10:
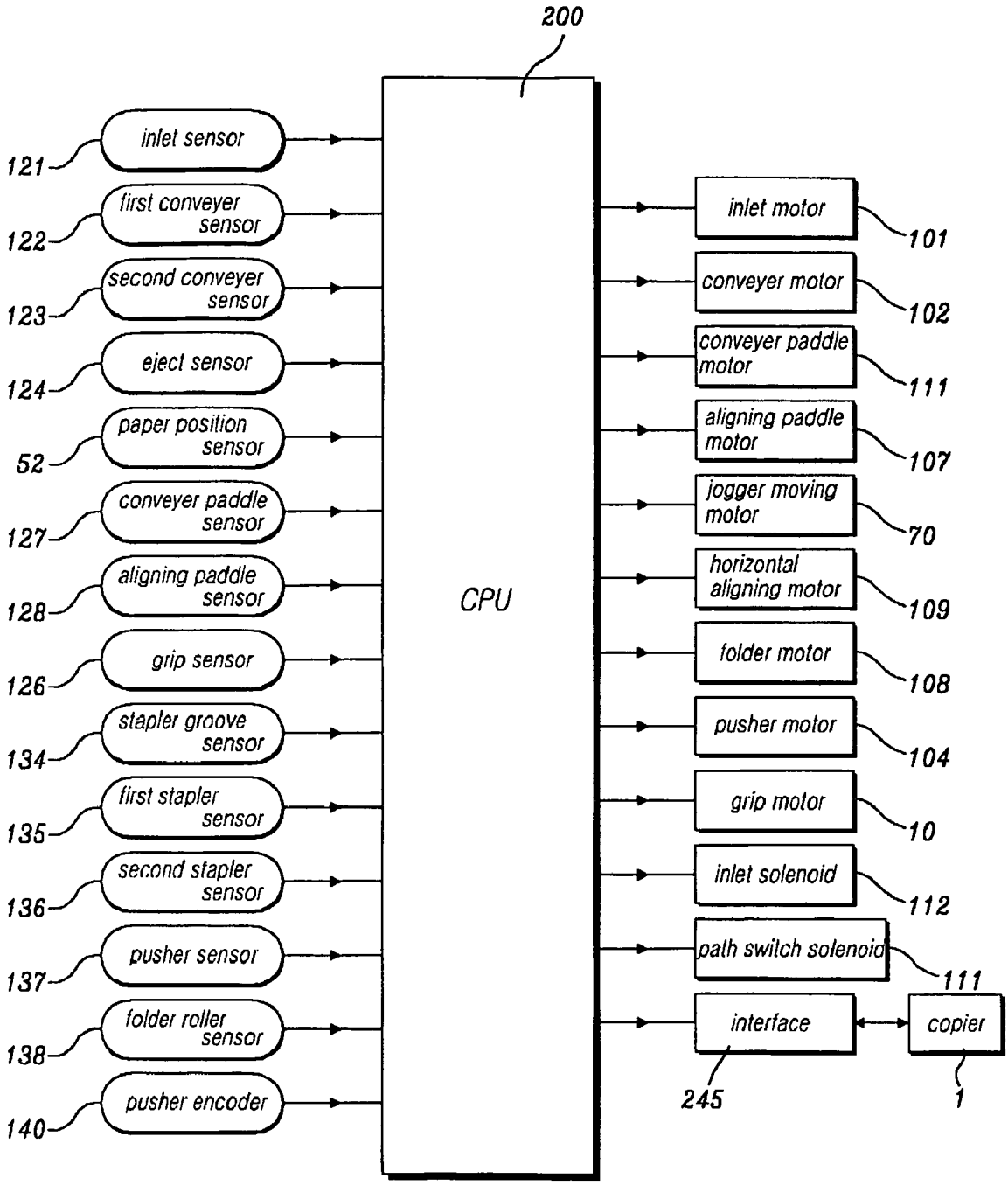
FIG. 10 is a block diagram illustrating a paper binding system according to the present invention.
Figure 11A:
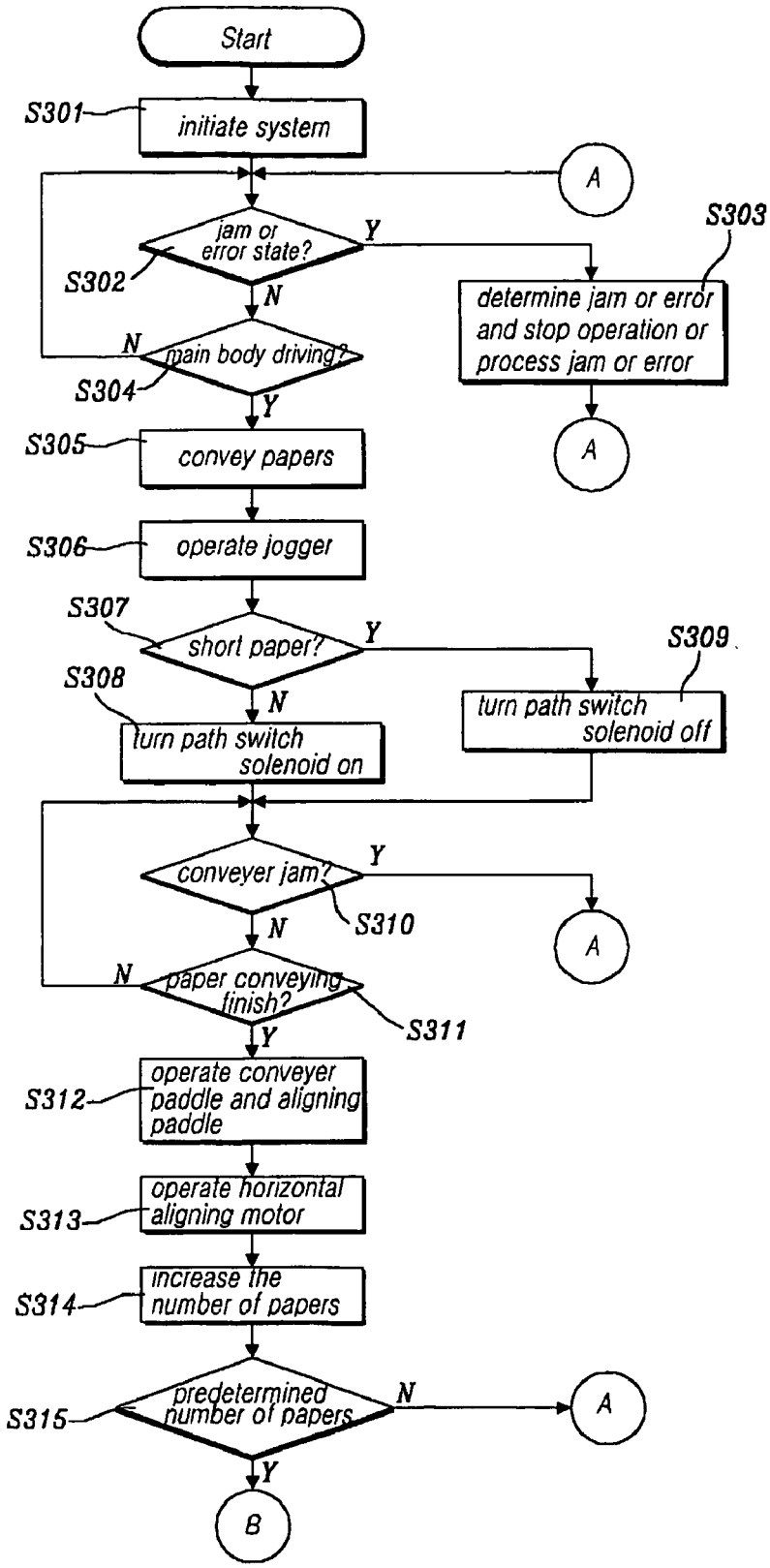
FIGS. 11*a* and 11*b* are flow charts illustrating the operation of driving a paper binding system according to the present invention.
Figure 11B:
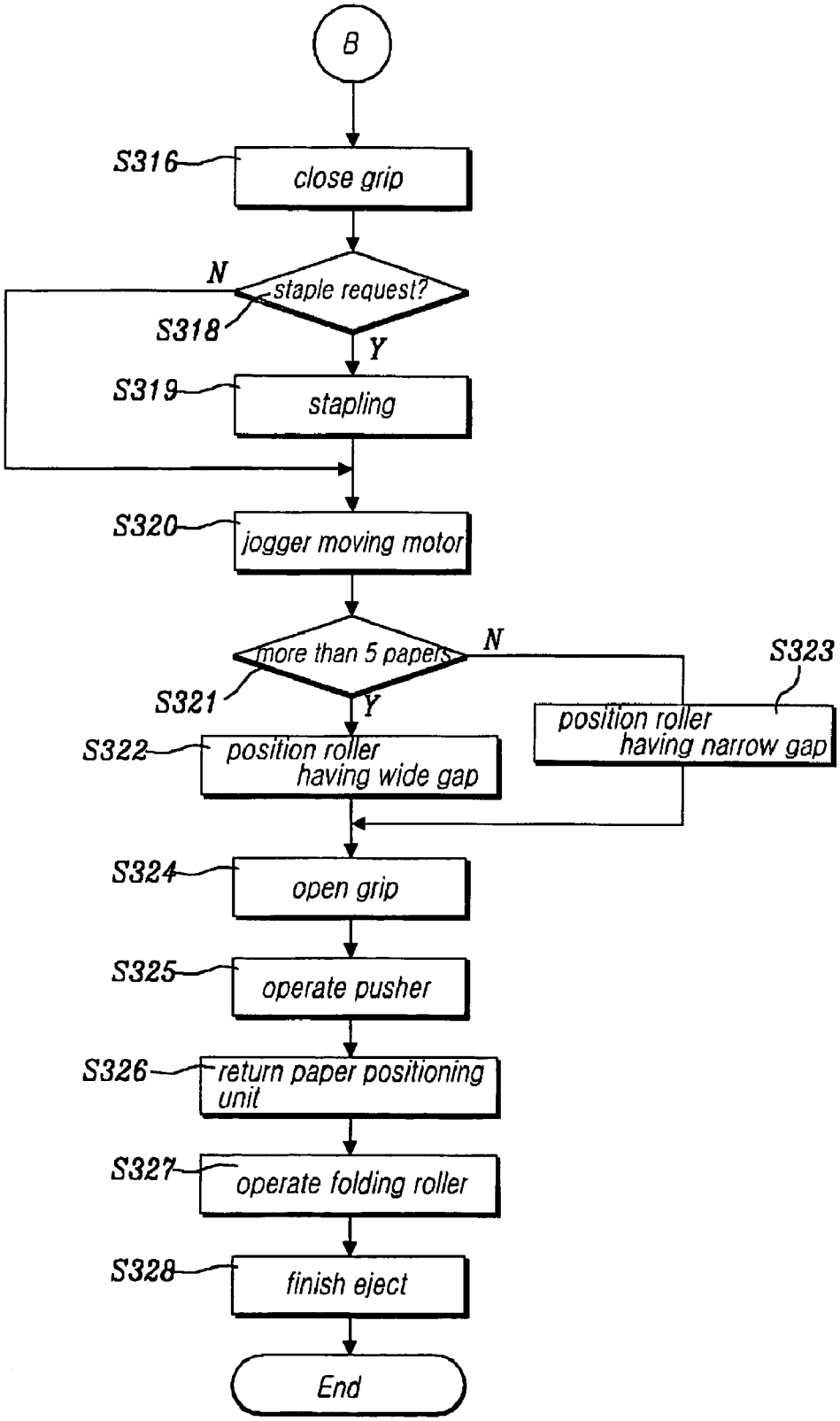

The operation of the aforementioned binding system will be described in more detail with reference to FIGS. 10 and 11.

The binding system is initiated in step S301.

In a state where the binding system is initiated, it is determined whether jam or error of the papers occurs in the binding system in step S302. The jam or error of the papers is determined by the CPU 200 in response to the signal of a sensor provided for each unit of respective elements.

As one example, if an inlet sensor 211, a first conveyer sensor 122, and a second conveyer sensor 123 provided in the paper moving means 150 sense the moving papers and transmit the papers to the CPU, the CPU compares a predetermined time with the paper sensing time sensed by the sensor. As a result, the CPU 200 determines whether jam or error of the papers occurs, or the papers normally move.

Once the CPU 200 determines that there is a jam or error in the papers when the papers move, the operation of the system stops until the papers are released from the jam or error.

Once a user releases jam or error of the papers in the binding system in step S303 and drives the main body of the copier in step S304, the papers finished from the copier move to the inlet sensor 121. The CPU 200 drives the inlet motor 101 by the signal of the inlet sensor 121 to rotate the lower roller 86. At the same time, the CPU 200 performs on/off control of the inlet solenoid 112 in response to a control signal input by the user.

The papers moved by on/off control of the inlet solenoid 112 move to the binding system or are ejected in a direction C without any finishing process.

If the inlet solenoid is operated to convey the papers into the binding system in step S305, the conveyer motor 102 is driven and the upper roller 85 is rotated by driving of the conveyer motor 102. Thus, the papers move to the inlet stack guide 83 and at the same time the jogger moving motor 70 of the paper positioning unit 88 is driven to move the paper positioning unit 88, so that the papers moving to the grip plate 30 are stacked on the grip plate 30 without being gripped until a predetermined number of papers move to the grip plate 30 in step S306.

The paper conveyer switch solenoid 111 is turned on/off depending on whether the papers moving to the inlet stack guide are short or long in step S307, i.e., which size of the papers among A4 sized papers, A5 sized papers, B4 sized papers, and B5 sized papers is moving to the inlet stack guide.

If it is determined that the short papers are moving to the inlet stack guide, the switch solenoid 111 is turned on in step S308 so that the papers move through a short paper moving path (not shown) formed in the inlet stack guide. If it is determined that the long papers are moving to the inlet stack guide, the switch solenoid 111 is turned off in step S309 so that the papers move to the grip plate 30 through a long paper moving path (not shown) formed in the inlet stack guide.

The CPU determines whether jam occurs in the papers when they are moving from the paper moving means 150 to the paper positioning unit 88 in step S310. At this time, the CPU senses whether there is a jam in the papers, in response to a paper sensing signal of the paper position sensor 52. If no jam occurs, the CPU determines whether the papers completely moved in step S311.

In the process of moving the papers to the grip plate 30, the paddle motor 42 and the aligning paddle motor 107 are driven to rotate the paddle 41 so that the papers are aligned in step S312.

Once the papers are aligned, the horizontal aligning motor 109 of the paper positioning unit 88 is driven to align the papers stacked on the grip plate in a horizontal direction in step S313.

Thus, the papers are stacked on the grip plate 30 in step S314 after passing through the above steps. The CPU determines whether the predetermined number of papers moved in response to the signal of the grip sensor 126 in step S315.

If the predetermined number of papers are normally stacked on the grip plate, the CPU outputs a signal for driving the grip motor 10 in response to the signal of the grip sensor and the grip plate grips the stacked papers in accordance with driving of the grip motor in step S316.

Once the papers stacked on the grip plate are gripped, the CPU determines whether a stapling request signal occurs in the stacked papers in step S318. If a stapling request signal occurs, the stapler unit 84 is driven to staple the papers gripped in the paper positioning unit 88 in step S319. If no stapling request signal occurs, the grip plate of the paper positioning unit 88 moves to the folding rollers of the folding means 151 in step S320. That is, the jogger moving motor 70 is driven to move the jogger 61, thereby resulting in that the grip plate gripping the papers at the lower part of the jogger moves to the folding rollers in a state where it grips the papers.

Once the papers gripped as above move to the folding rollers 89 and 91, the distance between the folding rollers is adjusted in accordance with the number of the gripped papers (the thickness of the papers). The adjusted distance between the folding rollers is sensed by the folder roller sensor 138.

For example, after the CPU determines whether more than 5 papers are gripped in step S321, if more than 5 papers are gripped, the distance between the folding rollers 89 and 91 is adjusted in a great range to conform to the thickness of the papers in step S322. On the other hand, if less than 5 papers are gripped, the distance between the folding rollers 89 and 91 is adjusted in a small range to conform to the thickness of the papers in step S323.

Once the distance between the folding rollers is normally adjusted and the folding sensors sense the position of the adjusted rollers, the grip motor 10 is driven to release the grip state of the papers gripped by the grip plate 30 in step S324.

Subsequently, the pusher motor 104 of the folding means is driven so that the knife 87*a* of the protrusion unit 87 can push the papers between the folding rollers 89 and 91 in a state where the papers are folded by half in step S325.

In this state, the paper positioning unit 88 returns to its original position in step S326, and the folder motor 108 is driven to rotate the folding rollers 89 and 91, thereby completing folding of the papers in step S327.

Once folding of the papers is completed, the papers are sensed by the eject sensor 124 and then stacked on the eject tray 135 in step S328.

INDUSTRIAL APPLICABILITY

The paper binding system of an image forming apparatus and the method for controlling the same according to the present invention have the following advantages.

In the present invention, the grip means driven by the worm gear and the cam serves as the paper support means instead of a roller and a plate spring which are unstable to support the papers. Thus, it is possible to more stably support the papers.

Furthermore, since the grip plate is driven using the worm gear and the worm wheel which are connected with the grip motor, reverse rotation of the worm wheel can be avoided. This can maintain the grip plate from the state where the grip plate grips the papers to the state where the grip plate is stopped, thereby improving reliability of the system.

Moreover, the binding system of the image forming apparatus is driven by the steps of moving the papers from the paper moving means to the paper positioning unit, gripping the moved papers, stapling the papers gripped by the paper positioning unit, moving the papers stapled by the stapler unit to the folding position of the folding means by moving the paper positioning unit, releasing the grip state of the stapled papers by driving the paper positioning unit, folding the stapled papers by driving the folding means, and ejecting the folded papers to the eject tray. In this case, it is possible to greatly improve reliability and stability of the system.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

What is claimed is:

1. A paper binding system of an image forming apparatus comprising:

a paper moving means moving papers ejected from the image forming apparatus;

a paper positioning unit temporarily receiving papers moved from the paper moving means and positioning them;

a stapler unit stapling the papers received in the paper positioning unit;

a folding means folding the stapled papers; and an eject tray receiving the papers finished through the stapler unit and/or the folding means, wherein the image forming apparatus includes a grip means moving the papers to a binding position in a state where it grips the papers and releasing the grip state of the papers when the papers are positioned in the binding position.

2. The paper binding system of an image forming apparatus according to claim 1, wherein the folding means includes folding rollers having an adjustable distance adjustable by the thickness of the binding papers.

3. The paper binding system of an image forming apparatus according to claim 2, wherein the distance between the folding rollers is adjusted relative to the whole thickness of the papers gripped by the grip means, and the papers are folded by moving between the folding rollers having the adjusted distance.

4. The paper binding system of an image forming apparatus according to claim 1, wherein the paper positioning unit includes a jogger that moves by means of a sliding means, the grip means is provided in the jogger and includes a cam means, a return spring, and a grip plate having a grip part, the grip plate is pushed up to an upper part by rotation of the cam means and descends by load of the grip plate and the return spring, and the papers are gripped and supported between the paper grip part of the descended grip plate and the jogger.

5. The paper binding system of an image forming apparatus according to claim 4, wherein the paper positioning unit further includes a stack guide that covers the jogger, the stack guide being provided with a slit at the center, a part of the grip plate and the paper grip part being protruded through the slit, the protruded grip plate moving along the jogger, and the papers being gripped between the stack guide and the paper grip part of the grip plate.

6. The paper binding system of an image forming apparatus according to claim 4, wherein the sliding means of the jogger is filled into two sliding shafts so the jogger can slide up and down.

7. The paper binding system of an image forming apparatus according to claim 4, wherein the jogger is fixed to a timing belt for moving the jogger and is slid up and down by the timing belt, the timing belt being provided in a jogger moving frame 60.

8. The paper binding system of an image forming apparatus according to claim 4, wherein the cam means includes a worm gear rotating on a worm wheel shaft, a cam fixed to the worm wheel shaft, and a protrusion pin protruded on the cam spaced apart from the central shaft of the worm wheel shaft, the protrusion pin being formed to push the grip plate up in accordance with a rotational position of the cam.

9. The paper binding system of an image forming apparatus according to claim 8, wherein the center part of the grip plate has a curved shape having a predetermined step part which is in contact with the protrusion pin to push the grip plate up.

10. A method for controlling a paper binding system of an image forming apparatus comprising the steps of:

a) moving papers from a paper moving means to a paper positioning unit;

b) gripping, in the paper positioning unit, the moved papers;

c) stapling, in a stapler unit, the papers gripped by the paper positioning unit;

d) moving the papers stapled by the stapler unit to a folding position of a folding means by moving the paper positioning unit;

e) releasing a grip state of the stapled papers by driving the paper positioning unit;

f) folding the stapled papers by driving the folding means; and g) ejecting the folded papers onto an eject tray.

11. The method according to claim 10, wherein the step f) includes the steps of controlling the folding means so that the distance between folding rollers of the folding means is adjusted relative to the thickness of the stapled papers, and folding the papers by moving the stapled papers between the folding rollers.

12. The method according to claim 10, wherein in the step b) the papers are gripped by means provided in the paper positioning unit, the grip means including a cam means, a return spring, and a grip plate having a paper grip part, and the grip plate being pushed to an upper part by rotation of the cam means and descending by load of the grip plate and the return spring.

13. The method according to claim 10, wherein in the step a) the moving papers are aligned by a paddle part provided in at least one or more position.

14. The method according to claim 10, wherein the part is respectively provided in the paper moving means and the paper positioning unit.

15. A paper binding system of an image forming apparatus comprising a paper moving means moving papers ejected from the image forming apparatus, a paper positioning unit temporarily receiving the papers moved from the paper moving means and positioning them, a stapler unit stapling the papers received in the paper positioning unit, a folding means folding the stapled papers, and an eject tray receiving the papers finished through the stapler unit and/or the folding means, wherein the stapler unit is fixed to a slide rail which is fitted into a fixed bracket for the slide rail, and a guide is provided to determine the fixing position when the stapler unit is fixed to a fixed base, the fixed bracket being fixed to the fixed base for the stapler unit and the slide rail sliding along the bracket.

16. The paper binding system according to claim 15, where the slide rail is formed by overlapping a plurality of plates, and a ball bearing is filled into a contact portion between the respective plates, the most upper plate being fixed to the stapler unit while the lowest plate being filled into the fixed bracket so as to enable sliding.

17. The paper binding system according to claim 15, wherein the guide includes a guide bracket fixed to the fixed base in parallel with the fixed bracket, and first and second guide blocks and respectively fixed front and rear sides at the upper part of the stapler unit so as to slide along the guide bracket.

18. The paper binding system according to claim 15, wherein the stapler unit is provided with a plug connector at a side and a receptacle connector at a side of the fixed base, the plug connector being fixed to or detached from the receptacle connector in accordance with fixation or detachment of the stapler unit.

19. A paper binding system of an image forming apparatus comprising:

a paper moving means moving papers ejected from the image forming apparatus;

a paper positioning unit temporarily receiving the papers moved from the paper moving means and positioning them;

a stapler unit stapling the papers received in the paper positioning unit;

a folding means for folding the stapled papers; and an eject tray receiving the papers finished through the stapler unit and/or the folding means, wherein the folding means comprises:

a pair of folding rollers provided with gaps on the circumference thereof, the gaps providing different distances by a predetermined interval to accommodate papers having different thickness;

a folder motor providing a rotational force to the folding rollers;

a folder roller sensor sensing the position of the folding rollers to adjust the distance between the rollers in accordance with the number of folding papers;

a protrusion unit knife pushing the folding position of the papers to move the papers between the folding rollers; and a pusher motor providing a driving force to allow the protrusion unit knife to move between the folding rollers.

20. The paper binding system according to claim 19, wherein the folding rollers have double circular sections by uniformly removing the circumference of each folding roller by a predetermined interval.

21. The paper binding system according to claim 19, wherein the folding means further includes a pressure means that connects with a shaft of the folding rollers and pressurizes the folding rollers to closely adhere to each other.

22. The paper binding system according to claim 1, wherein the folding means includes folding rollers having a first portion and a second portion, the first portion of each folding roller has a first diameter and the second portion of each folding roller has a second diameter, different from the first diameter.

23. The paper binding system according to claim 19, wherein the gaps of the folding rollers comprise a cut section partially about a circumference of the folding rollers.

24. The paper binding system according to claim 19, wherein the image forming apparatus includes a grip means moving the papers to a binding position in a state where it grips the papers and releasing the grip state of the papers when the papers are positioned in the binding position.

* * * * *